US005893017A

United States Patent [19]

Yamamoto

[11] Patent Number: 5,893,017

[45] Date of Patent: Apr. 6, 1999

[54] IMAGE FORMING APPARATUS

[75] Inventor: Yoshikazu Yamamoto, Kawasaki, Japan

[73] Assignee: Fujitsu Limited, Kawasaki, Japan

[21] Appl. No.: 917,876

[22] Filed: Aug. 27, 1997

[30] Foreign Application Priority Data

Jan. 22, 1997 [JP] Japan ..... 9-009808

[51] Int. Cl.[6] ..... G03G 15/01

[52] U.S. Cl. ..... 399/299; 399/317

[58] Field of Search ..... 399/66, 297, 299, 399/317, 31

[56] References Cited

U.S. PATENT DOCUMENTS

| | | | |
|---|---|---|---|
| 4,887,101 | 12/1989 | Hirose et al. | 399/31 X |
| 5,303,018 | 4/1994 | Terada et al. | 399/299 |
| 5,365,324 | 11/1994 | Gu et al. | 399/299 |
| 5,376,999 | 12/1994 | Hwang | 399/299 |
| 5,386,286 | 1/1995 | Kinouchi et al. | 399/299 X |
| 5,765,082 | 6/1998 | Numazu et al. | 399/299 |

FOREIGN PATENT DOCUMENTS 01-255871 10/1989 Japan .

*Primary Examiner*—Arthur T. Grimley
*Assistant Examiner*—Sophia S. Chen
*Attorney, Agent, or Firm*—Armstrong, Westerman, Hattori, McLeland, & Naughton

[57] ABSTRACT

An image forming apparatus includes a transport belt for transporting a medium, image forming units for transferring a toner image onto the medium transported by the transport belt, and contacting/separating mechanisms for moving at least one of the transport belt and the image forming units to a contact position where the transport belt and the image forming units contact each other and to a separated position where the transport belt and the image forming units are separated from each other, where the contacting/separating mechanisms move at least one of the transport belt and the image forming units to the contact position and/or the separated position in a state where a transport speed of the transport belt and a transfer speed of the image forming units are approximately the same.

13 Claims, 25 Drawing Sheets

FIG. 15

RECEDE TIMING PAGE NUMBER INFORMATION

| | |
|---|---|
| FLAG | YELLOW (Y) RECEDE TIMING PAGE NUMBER |
| FLAG | MAGENTA (M) RECEDE TIMING PAGE NUMBER |
| FLAG | CYAN (C) RECEDE TIMING PAGE NUMBER |
| FLAG | BLACK (K) RECEDE TIMING PAGE NUMBER |

→ RECEDE CONTROL NECESSARY/UNNECESSARY ( 0:UNNECESSARY, 1:NECESSARY )

FIG. 16

OPERATOR RECEDE/RETURN INSTRUCTION INFORMATION

| | | | |
|---|---|---|---|
| Y | M | C | K |

→ BLACK (K) RECEDE INSTRUCTION (0:NO, 1:YES)

→ CYAN (C) RECEDE INSTRUCTION (0:NO, 1:YES)

→ MAGENTA (M) RECEDE INSTRUCTION (0:NO, 1:YES)

→ YELLOW (Y) RECEDE INSTRUCTION (0:NO, 1:YES)

IMAGE FORMING APPARATUS

BACKGROUND OF THE INVENTION

The present invention generally relates to image forming apparatuses, and more particularly to an image forming apparatus which forms a multi-color (color) image on a medium such as paper.

An electrophotography type image forming apparatus which transfers a toner image on a medium is applied to printers, copying machines, facsimile machines and the like. Recently, image forming apparatuses which form color images have become popular.

Generally, as shown in FIG. 1, a color printer 100 is connected to a host computer 110 which is provided as a host unit, and the color printer 100 makes a color printing with respect to predetermined paper by receiving data from the host computer 110.

Normally, the printer 100 includes a color printing mechanism engine 101, a duplex unit 102, hoppers 103 and 104, a cassette 105, a tray 106, a stacker 107 and an operation panel 108.

The color printing mechanism engine 101 forms a mechanism for making the color printing with respect to the predetermined paper, and the duplex unit 102 forms a mechanism for making a duplex printing with respect to the predetermined paper.

The hoppers 13 and 14 store plain paper of predetermined sizes as printing paper. The cassette 105 stores color paper that is supplied after a print job is completed and before a next print job is started, so as to distinguish the print jobs. Printed paper are ejected onto the tray 106 and the stacker 107.

The operation panel 108 includes control keys and switches for inputting various instructions with respect to the printer 100, a display for displaying the operating state of the printer 100, and the like. In FIG. 1, a main console 111 is provided on the host computer 110. This main console 111 is provided with control keys, switches, a display and the like, and this main console 111 is used when an operator needs to monitor or intervene with the operation of the host computer 110.

As shown in FIG. 2, the color printing mechanism engine 101 is made up of four color printing units 111Y, 111M, 111C and 111K. The color printing units 111Y, 111M, 111C and 111K are respectively provided to carry out the printing using a corresponding one of the colors which are yellow (Y), magenta (M), cyan (C) and black (K). Each of the color printing units 111Y, 111M, 111C and 111K has a developing unit 112, a photoconductive body or drum 113, an optical unit 114 and a transfer roller 115.

The developing unit 112, the photoconductive drum 113, the optical unit 114 and the transfer roller 115 which form each of the color printing units 111Y, 111M, 111C and 111K are extremely well known, and a detailed description thereof will be omitted.

A reference numeral 116 denotes a fixing unit, and a reference numeral 117 denotes a paper transport path.

In the color printing mechanism engine 101 having the construction shown in FIG. 2, the paper supplied from the hopper 103 or 104 is transported from the color printing unit 111Y towards the color printing unit 111K along the paper transport path 117, and toner of a corresponding color is transferred onto the paper by each of the color printing units 111Y, 111M, 111C and 111K. The toner transferred onto the paper is fixed by the fixing unit 116, thereby making the color printing.

However, according to the color printer 100 provided with the color printing units 111Y, 111M, 111C and 111K described above, all of the color printing units 111Y, 111M, 111C and 111K are always operated even when carrying out the printing using a single color. For this reason, the photoconductive drum 113 of the color printing unit which is not frequently used wears out and a developing agent used in this color printing unit deteriorates, thereby causing a problem in that the color printing unit which is not used frequently has a short serviceable life.

In addition, because the color printing unit which is not used is also operated simultaneously as the other color printing units which are used, there are problems in that unnecessary power is consumed, and residual toner on the photoconductive drum 113 of the color printing unit which is not used adheres onto the paper as stain, thereby deteriorating the printing quality.

SUMMARY OF THE INVENTION

Accordingly, it is an object of the present invention to provide a novel and useful image forming apparatus in which the problems described above are eliminated.

Another and more specific object of the present invention is to provide an image forming apparatus which can reduce the power consumption, extend the serviceable life of the image forming unit (photoconductive body and developing agent) which is not used frequently, and improve the quality of the image which is formed by positively preventing the toner of the unused color from adhering onto the medium as stain.

Still another object of the present invention is to provide an image forming apparatus comprising transport means for transporting a medium; image forming means for transferring a toner image onto the medium transported by said transport means; and contacting/separating means for moving at least one of said transport means and said image forming means to a contact position where said transport means and said image forming means contact each other and to a separated position where said transport means and said image forming means are separated from each other, said contacting/separating means moving at least one of said transport means and said image forming means to the contact position and/or the separated position in a state where a transport speed of said transport means and a transfer speed of said image forming means are approximately the same. According to the image forming apparatus of the present invention, it is possible to reduce the power consumption, to extend the serviceable life of the image forming means which is not used frequently, to improve the quality of the image which is formed by positively preventing the toner of the unused color from adhering onto the medium as stain, and to reduce stress on the transport means so as to extend the serviceable life of the transport means.

Other objects and further features of the present invention will be apparent from the following detailed description when read in conjunction with the accompanying drawings.

BRIEF DESCRIPTION OF THE DRAWINGS

FIG. 15 is a diagram showing recede timing page number information of the first embodiment;

FIG. 16 is a diagram showing operator recede/return instruction information of the first embodiment;

DETAILED DESCRIPTION OF THE INVENTION

Figure 3:
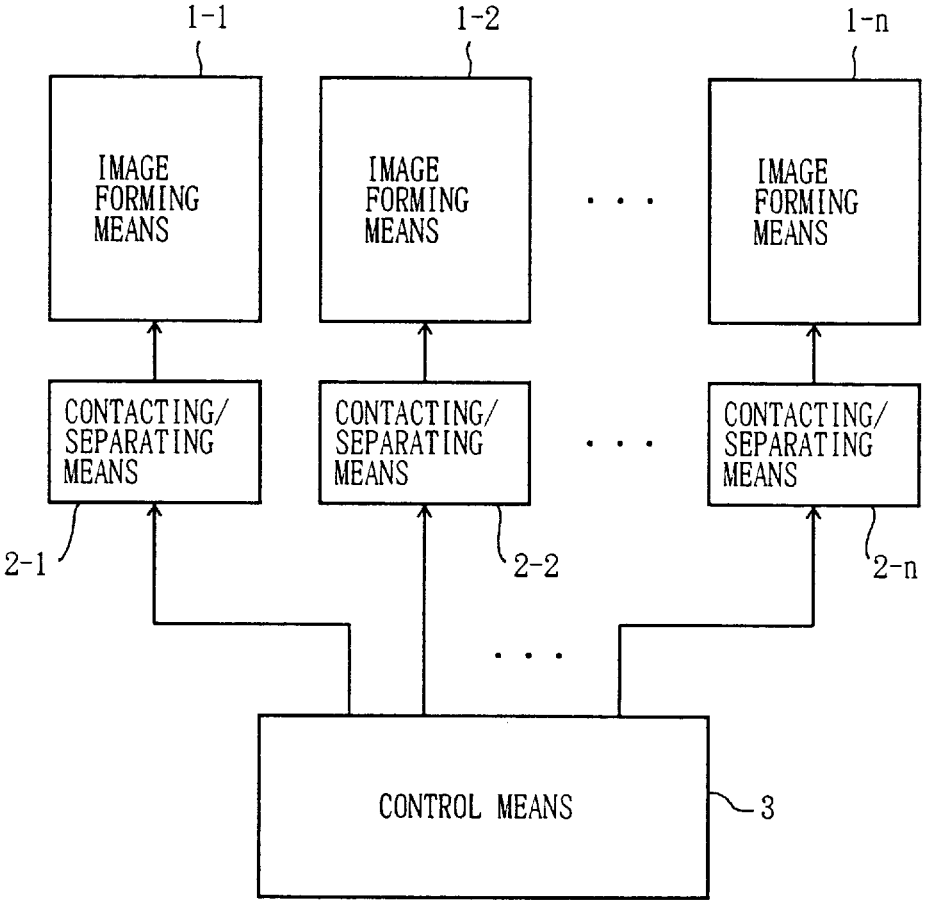
FIG. 3 is a system block diagram showing the basic construction of the present invention.

First, a description will be given of the oeprating principle of the present invention, by referring to FIG. 3. FIG. 3 is a system block diagram showing the basic construction of an image forming apparatus according to the present invention. In FIG. 3, the image forming apparatus generally includes image forming means 1-1 through 1-n, contacting/separating means 2-1 through 2-n, and a control means 3. Each of the image forming means 1-1 through 1-n transfers a toner image onto a medium such as paper that is transported by a transport means (not shown). The contacting/separating means 2-1 through 2-n move at least one of the transport means and the corresponding image forming means 1-1 through 1-n to a contact position where the transport means and the corresponding image forming means 1-1 through 1-n contact each other and to a separated position where the transport means and the corresponding image forming means 1-1 through 1-n are separated from each other. The contacting/separating means 2-1 through 2-n move at least one of the transport means and the corresponding image forming means 1-1 through 1-n to the contact position and/or the separated position in a state where a transport speed of the transport means and a transfer speed of the corresponding image forming means 1-1 through 1-n are approximately the same. The control means 3 independently controls each of the contacting/separating means 2-1 through 2-n.

For example, the transport means is made up of a belt which transports the medium, the contacting/separating means 2-1 through 2-n comprise mechanisms for contacting and separating the belt with respect to the image forming means 1-1 through 1-n, and the control means 3 controls operation timings of the mechanisms.

When the image forming means 1-1 through 1-n use toners of different colors, it is possible to form a multi-color image, that is, a color image.

According to the present invention, it is possible to reduce the power consumption, to extend the serviceable life of the image forming means which is not used frequently, to improve the quality of the image which is formed by positively preventing the toner of the unused color from adhering onto the medium as stain, and to reduce stress on the transport means so as to extend the serviceable life of the transport means.

Next, a description will be given of a first embodiment of the image forming apparatus according to the present invention.

Figure 1:
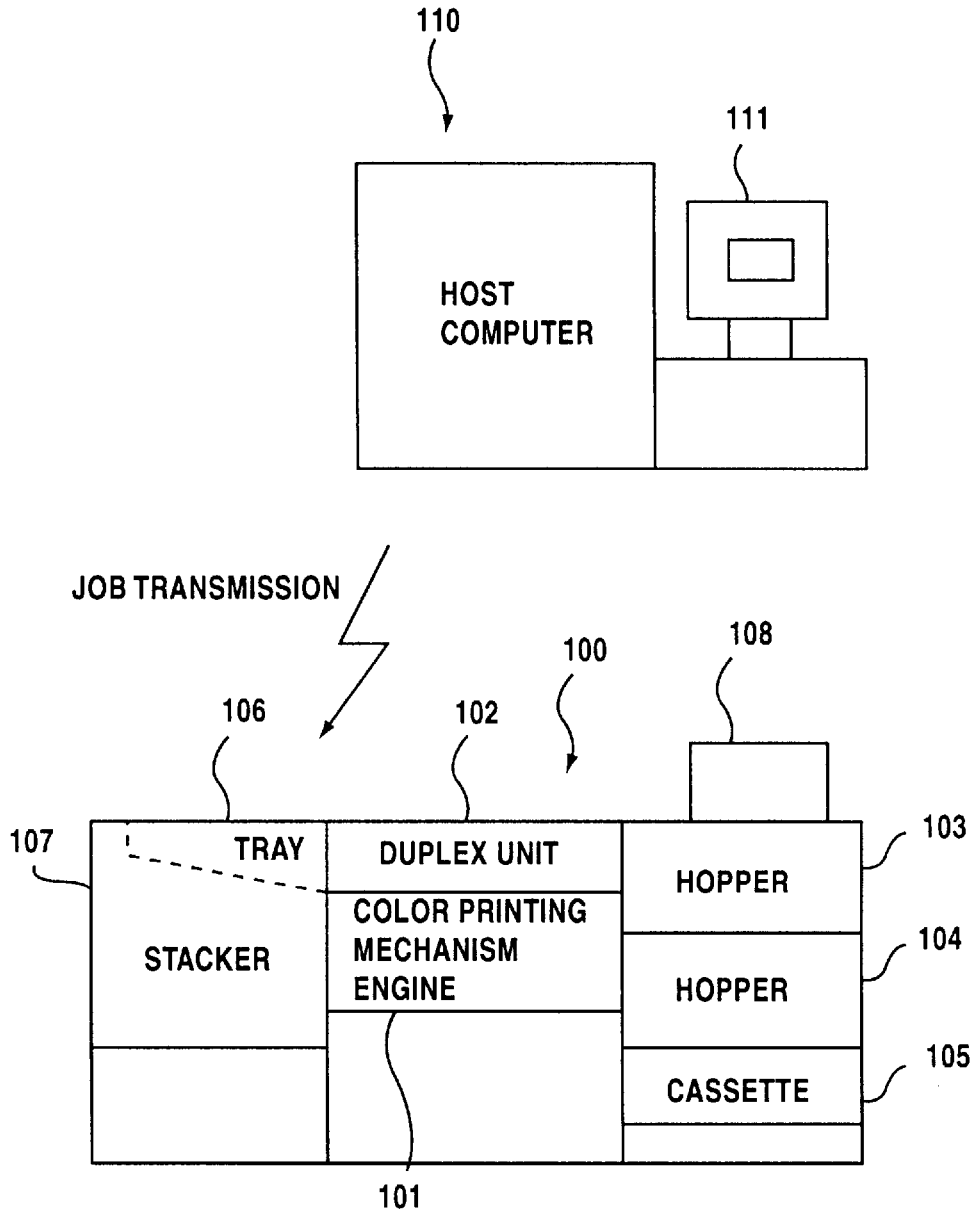
FIG.1 PRIOR ART
FIG. 1 is a schematic diagram showing the general construction of a general printer.
Figure 2:
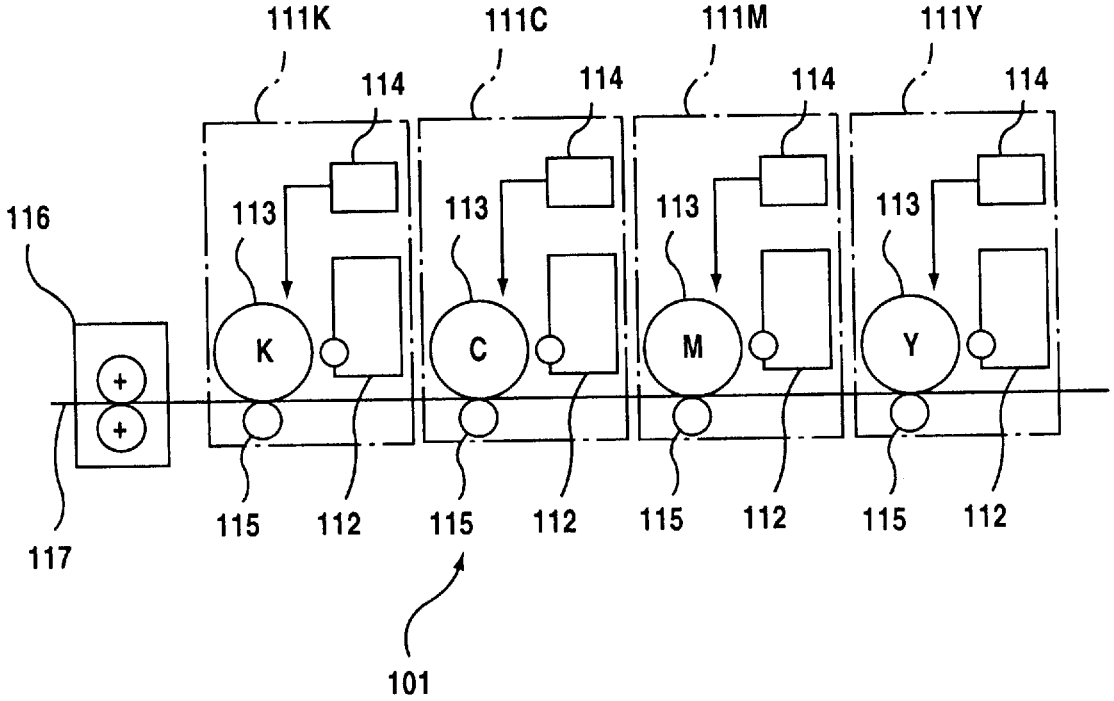
FIG.2 PRIOR ART
FIG. 2 is a schematic diagram showing the internal construction of a color printing mechanism engine.
Figure 4:
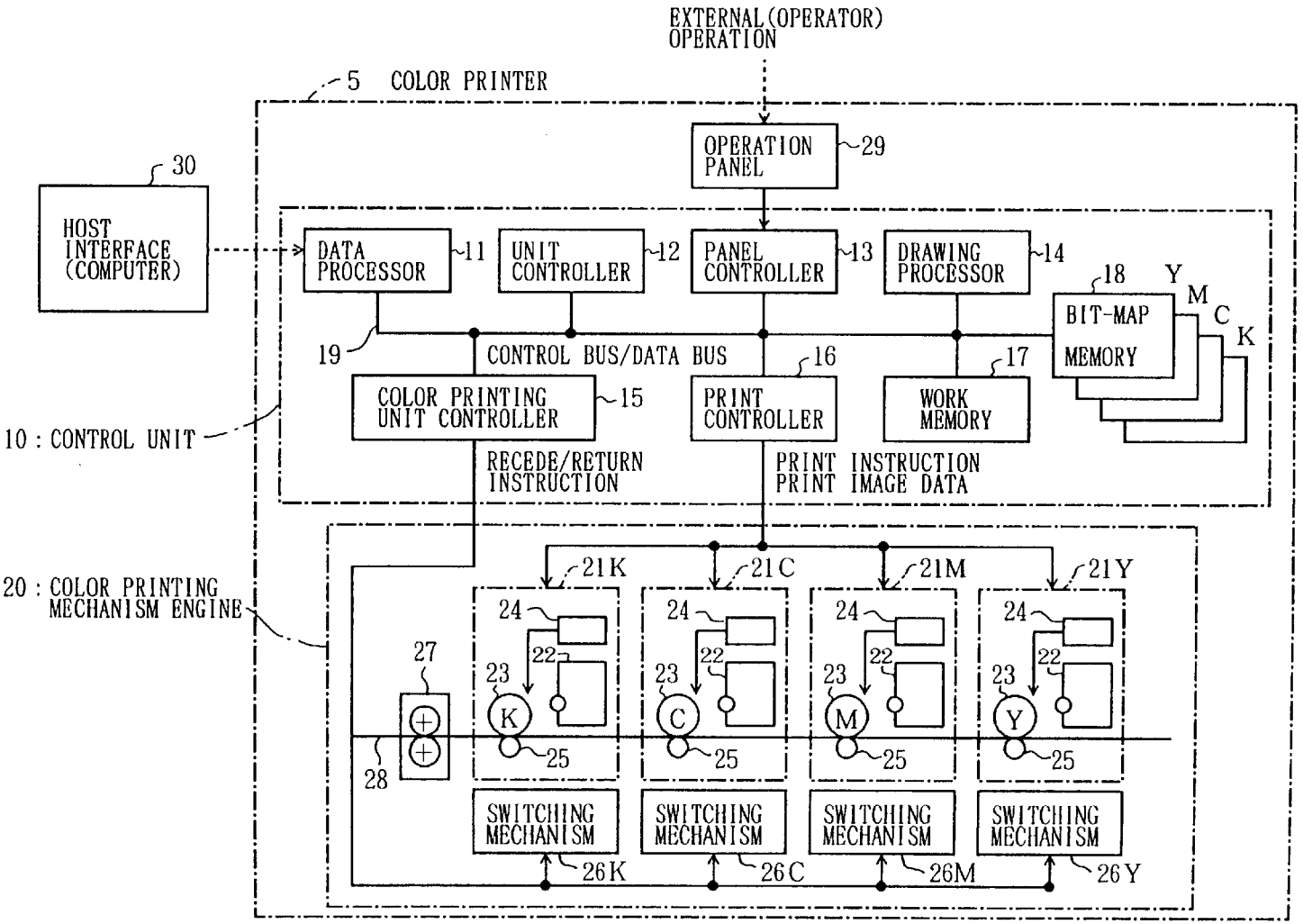
FIG. 4 is a system block diagram showing a color printer as a first embodiment of the present invention.

FIG. 4 is a system block diagram showing the first embodiment of the image forming apparatus according to the present invention. In this embodiment and a second embodiment which will be described later, the present invention is applied to a color printer. A color printer 5 shown in FIG. 4 generally has a construction similar to that of the color printer 100 described above in conjunction with FIG. 1. In other words, the color printer 5 is connected to a host interface 30 such as a host computer, and the color printer 5 prints data on predetermined paper when the data are received from the host interface 30.

In addition, as shown in FIG. 4, the color printer 5 is provided with a color printing mechanism engine 20, a control unit 10 and an operation panel 29. This operation panel 29 is used when an operator inputs various instructions from outside to set the color printer 5 to various operating states.

The color printing mechanism engine 20 forms a mechanism for making the color printing with respect to predetermined paper. The color printing mechanism engine 20 includes four independent color printing units 21Y, 21M, 21C and 21K, switching mechanisms 26Y, 26M, 26C and 26K, a fixing unit 27, and a paper transport path 28.

The color printing units 21Y, 21M, 21C and 21K respectively carry out the printing with respect to the printing paper using the corresponding colors which are yellow (Y), magenta (M), cyan (C) and black (K), so as to overlap a plurality of colors and realize the color printing. Each of the color printing units 21Y, 21M, 21C and 21K is made up of a developing unit 22, a photoconductive body or drum 23, an optical unit 24 and a transfer roller 25. The developing unit 22, the photoconductive drum 23, the optical unit 24 and the transfer roller 25 which form each of the color printing units 21Y, 21M, 21C and 21K are extremely well known, and a detailed description thereof will be omitted.

The switching mechanisms 26Y, 26M, 26C and 26K respectively switch the states of the color printing units 21Y, 21M, 21C and 21K to either a returned state where a corresponding one of the color printing units 21Y, 21M, 21C and 21K carries out the printing with respect to the printing paper or a receded state where a corresponding one of the color printing units 21Y, 21M, 21C and 21K does not make direct contact with the printing paper. The switching mechanisms 26Y, 26M, 26C and 26K are respectively provided with respect to the corresponding color printing units 21Y, 21M, 21C and 21K.

Each of the switching mechanisms 26Y, 26M, 26C and 26K has a construction which will be described later in detail with reference to FIGS. 5 through 7. The switching mechanisms 26Y, 26M, 26C and 26K carry out switching operations with respect to recede/return operations of the color printing units 21Y, 21M, 21C and 21K depending on a print instruction from the control unit 10.

The control unit 10 receives print data and commands from the host interface 30. In addition, when the operator inputs or sets the print conditions and the print instruction from the operation panel 29, the control unit 10 controls the color printing mechanism engine 20 depending on the print conditions and the print instruction so as to print the print data from the host interface 30.

The control unit 10 includes a data processor 11, a printer controller 12, a panel controller 13, a drawing processor 14, a color printing unit controller 15, a print controller 16, a work memory 17, and bit-map memories 18.

Figure 10:
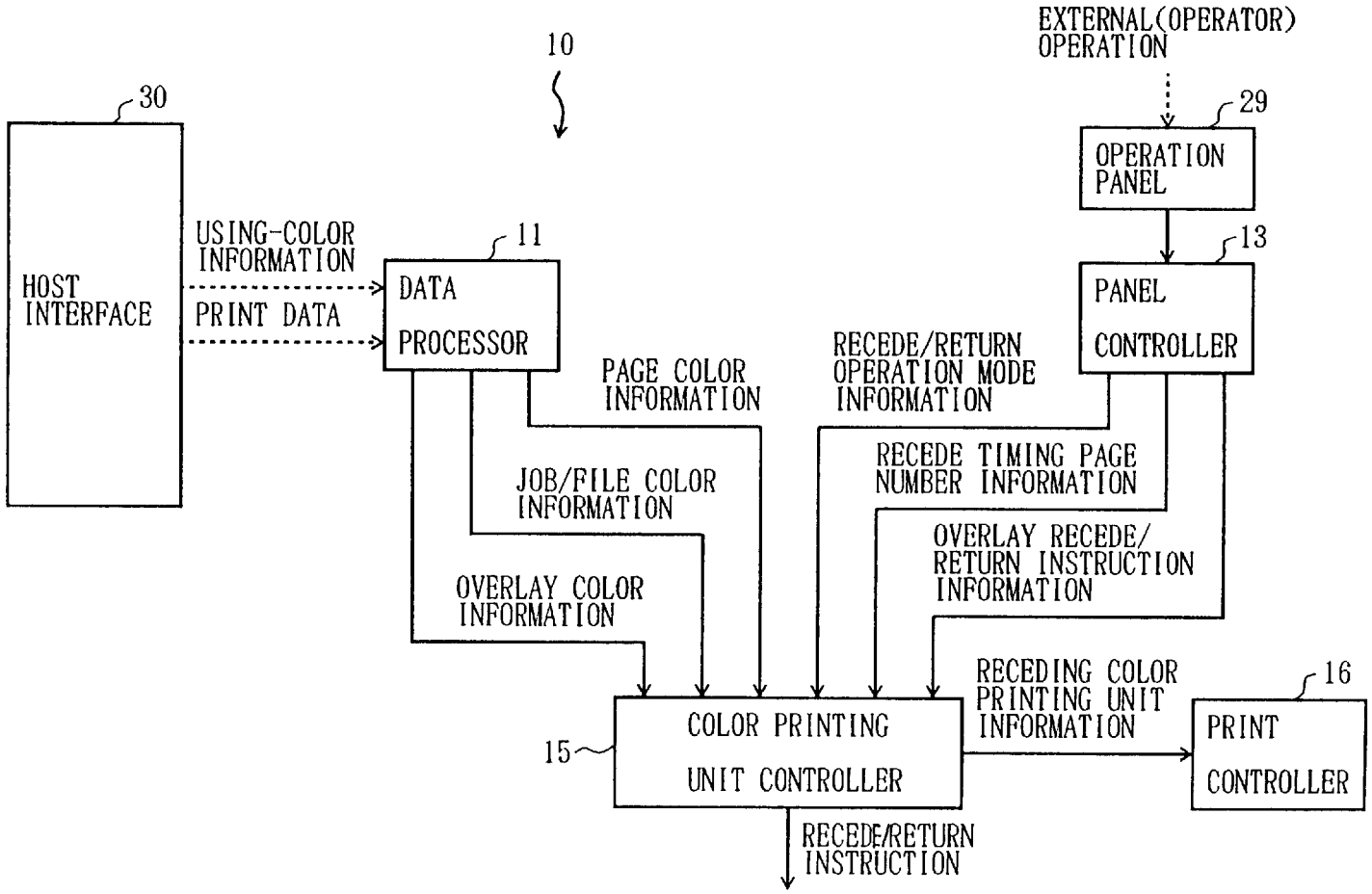
FIG. 10 is a system block diagram showing the flow of various information related to the recede/return of the color printing unit of the first embodiment.

As shown in FIG. 10, the data processor 11 receives the print data and using-color information from the host interface 30. The print data includes characters, graphics, images, and overlay (overlay will be described later), while the using-color information relates to the color to be used. The data processor 11 analyzes the colors to be used to print the print data out of the yellow (Y), magenta (M), cyan (C) and black (K) based on the using-color information, and supplies to the drawing processor 14 an analysis result of the using-color information and a developing/drawing request of the print data. The data processor 11 also has a function of supplying to the color printing unit controller 15 overlay color information which will be described later in conjunction with FIGS. 10 through 13, job/file color information, and page color information depending on the above described analysis result of the using-color information.

The printer controller 12 generally controls and manages the entire color printer 5.

The panel controller 13 has the functions of analyzing input information from various setting switches (not shown) of the operation panel 29 and notifying an analysis result to the controllers 12, 15 and 16, and controlling a message display state of a display (not shown) of the operation panel 29. In other words, the panel controller 13 manages the communication between the operator and the color printer 5 via the operation panel 29. In this embodiment, the panel controller 13 notifies to the color printing unit controller 15 recede/return operation mode information, recede timing page number information, operator recede/return instruction information which will be described later in conjunction with FIG. 10 and FIGS. 14 through 16, which are input and set by the operator from the operation panel 29.

The drawing processor 14 develops and draws the print data which is requested from the data processor 11 to be developed and drawn into each of the yellow (Y), magenta (M), cyan (C) and black (K) bit-map memories 18 based on the using-color information.

The color printing unit controller 15 outputs the recede/return instructions with respect to each of the switching mechanisms 26Y, 26M, 26C and 26K of the color printing mechanism engine 20 according to flow charts shown in FIGS. 18 through 23, based on various information from the data processor 11 or the panel controller 13, which will be described later with reference to FIGS. 10 through 16. The color printing unit controller 15 judges an unused color from the yellow (Y), magenta (M), cyan (C) and black (K) when a predetermined unused condition which will be described later is satisfied. The color printing unit controller 15 has a function of controlling the switching operations of the switching mechanisms 26Y, 26M, 26C and 26K of the color printing units 21Y, 21M, 21C and 21K so as to switch the states of those color printing units 21Y, 21M, 21C and 21K corresponding to the unused colors to the receded states.

Depending on the recede/return operation mode information input from the operation panel 29 via the panel controller 13, the color printing unit controller 15 executes one of a page unit timing recede/return process mode (first mode), a job/file timing recede/return process mode (second mode), an operator setting timing recede/return process mode (third mode) and an overlay print timing recede/return process mode (fourth mode).

The page unit timing recede/return process mode (first mode) carries out a procedure which will be described later in conjunction with FIGS. 19 and 20. In this first mode, the above described predetermined unused condition is that a color is not used while the color printing is carried out consecutively with respect to the printing paper for a prescribed number of pages. In this state, when a page to be subjected to the color printing using at least one of the color printing units 21Y, 21M, 21C and 21K which is switched to the receded state appears, the color printing unit controller 15 controls the switching operations of the switching mechanisms 26Y, 26M, 26C and 26K so as to switch the corresponding one of the color printing units 21Y, 21M, 21C and 21K from the receded state to the returned state. The prescribed number of pages is set for each of the color printing units 21Y, 21M, 21C and 21K, that is, for each of the colors, depending on the recede timing page number information that is input from the operation panel 29 via the panel controller 13.

The job/file timing recede/return process mode (second mode) carries out a procedure which will be described later in conjunction with FIG. 21. In this second mode, the above described predetermined unused condition is that a color is judged as not being used while the data of the print file or the print job from the host interface 30 is printed, based on the using-color information received prior to the data of the print file or the print job from the host interface 30.

Figure 22:
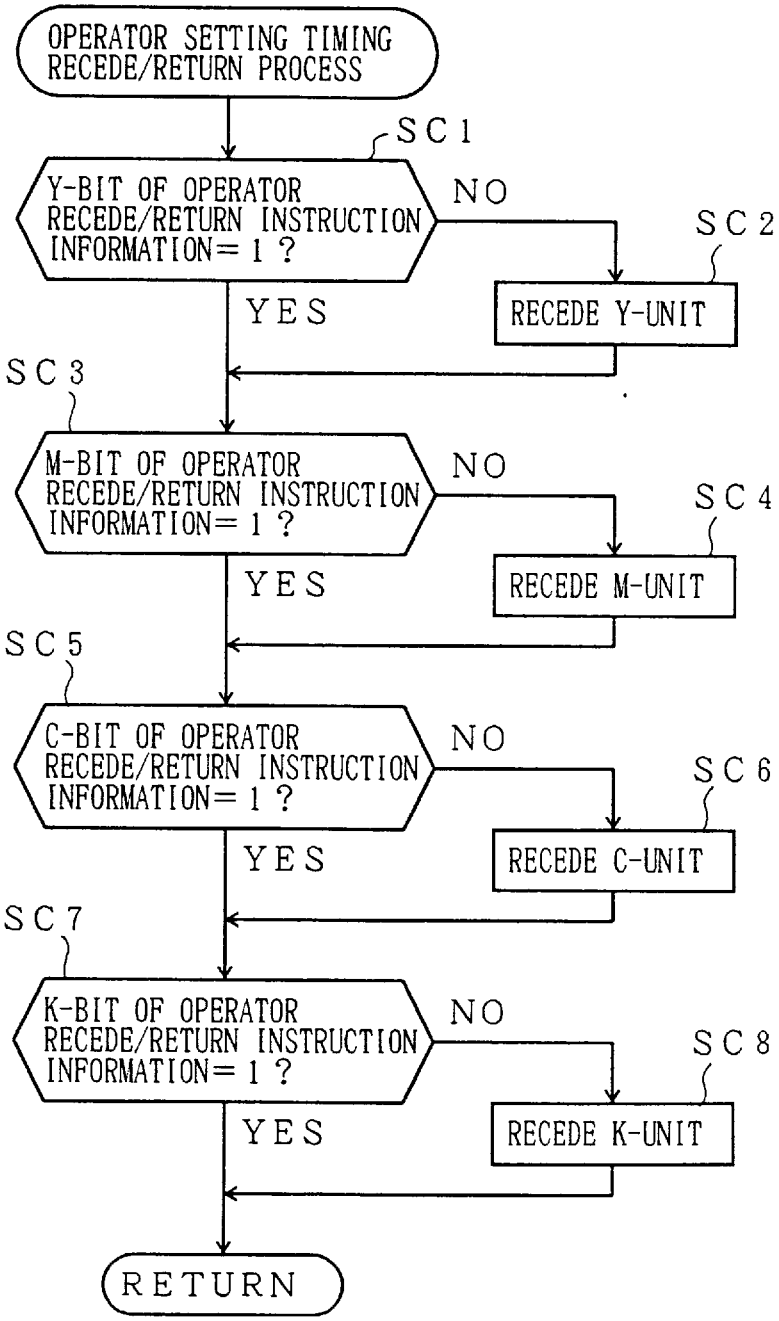
FIG. 22 is a flow chart for explaining an operator setting timing recede/return process as a third mode of the first embodiment.

The operator setting timing recede/return process mode (third mode) carries out a procedure which will be described later in conjunction with FIG. 22. In this third mode, the above described predetermined unused condition is that a color is specified as the operator recede/return instruction information from the operation panel 29 via the panel controller 13.

Figure 23:
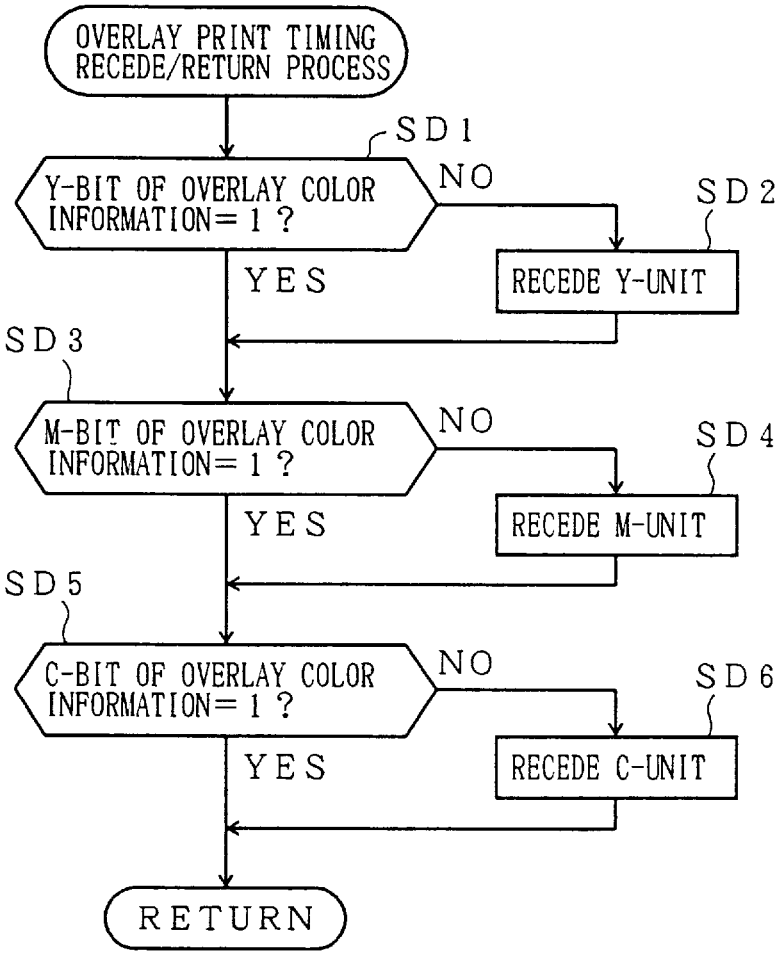
FIG. 23 is a flow chart for explaining an overlay print timing recede/return process as a fourth mode of the first embodiment.

The overlay print timing recede/return process mode (fourth mode) carries out a procedure which will be described later in conjunction with FIG. 23. In this fourth mode, the above described predetermined unused condition is that a color is judged as not being used while an overlay printing is carried out, based on the overlay color information received prior to an overlay print request from the host interface 30.

The color printing unit controller 15 functions similarly when a plurality of unused colors exists and a plurality of color printing units corresponding to the unused colors exist.

Figure 17:
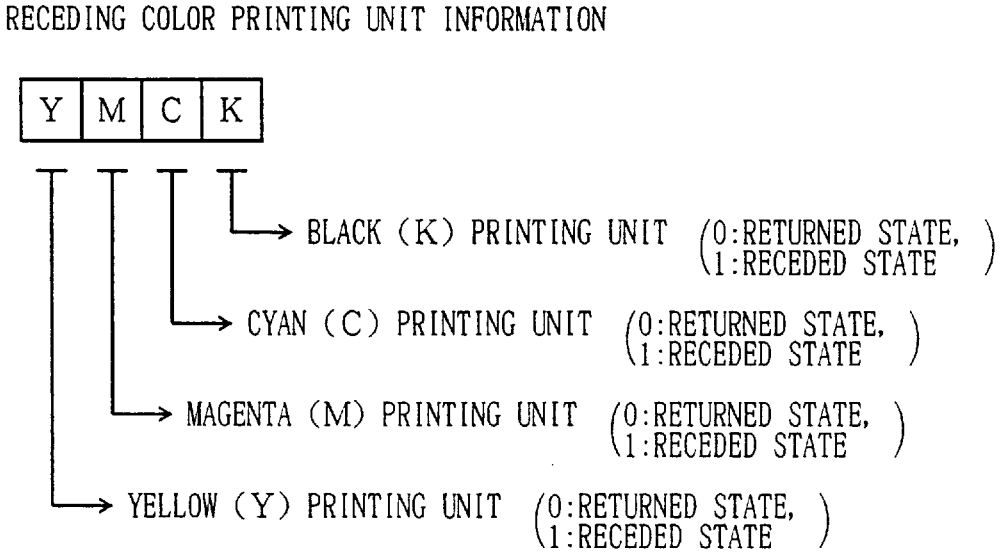
FIG. 17 is a diagram showing receding color printing unit information of the first embodiment.

In addition, the color printing unit controller 15 also has a function of notifying to the print controller 16 receding color printing unit information shown in FIG. 17 which indicates the color printing unit in the receded state.

On the other hand, based on the receding color printing unit information from the color printing unit controller 15 and each of the yellow (Y), magenta (M), cyan (C) and black (K) bit-map information which are developed and drawn by the drawing processor 14, the print controller 16 transfers print image data corresponding to yellow (Y), magenta (M), cyan (C) and black (K) to the color printing mechanism engine 20, so as to control the printing operation of the color printing mechanism engine 20.

The work memory 17 functions as a buffer which stores control tables for carrying out various controls of the color printer 5 and temporarily stores the print data from the host interface 30. Hence, the work memory 17 stores various data such as APTAN file, ATT (Alphanumeric Translation Table), KTT (Kanji Translation Table), merge rule and the like) which are required to analyze the printing data such as character font information, and various conditions which are input and set from the operation panel 29.

Furthermore, the bit-map memory 18 is provided for each of the basic primary colors which are black (K), yellow (Y), magenta (M) and cyan (C). The print image data of each color are developed and drawn in the corresponding bit-map memory 18 by the drawing processor 14.

In the control unit 10, the above described data processor 11, the printer controller 12, the panel controller 13, the drawing processor 14, the color printing unit controller 15, the print controller 16, the work memory 17 and the bit-map memories 18 are coupled via buses 19 which include a control bus, a data bus and the like.

As described above, the operator inputs the various instructions from outside via the operation panel 29. Hence, the operation panel 29 is used to set various operating states of the color printer 5, and has functions of a page number setting part, an unused color specifying part and a mode specifying part.

In other words, the function of the operation panel 29 as the page number setting part is used to set from the outside prescribed pages, that is, recede timing page number information, for which the unused condition stands for each of the color printing units 21Y, 21M, 21C and 21K, when selecting the page unit timing recede/return process mode, as described above.

The function of the operation panel 29 as the unused color specifying part is used to specify from the outside the unused colors as the operator recede/return instruction information when selecting the operator setting timing recede/return process mode when the unused colors are known in advance, as described above.

Furthermore, the function of the operation panel 29 as the mode specifying part is used to specify from the outside one of the four modes, that is, one of the first through fourth modes related to the predetermined unused condition, as the recede/return operation mode information, as described above.

Next, a description will be given of the recede/return switching operation of each of the color printing units 21Y, 21M, 21C and 21K in the color printing mechanism engine 20, by referring to FIGS. 5 through 9.

The recede/return switching operation of each of the color printing units 21Y, 21M, 21C and 21K is carried out by each of the switching mechanisms 26Y, 26M, 26C and 26K, as described above.

Figure 5:
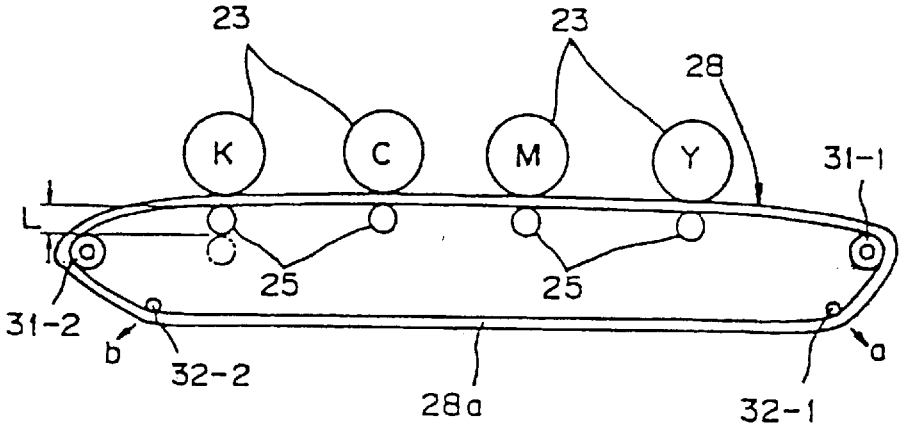
FIG. 5 is a diagram showing a paper transport path and its vicinity in a color printing mechanism engine of the first embodiment.
Figure 6:
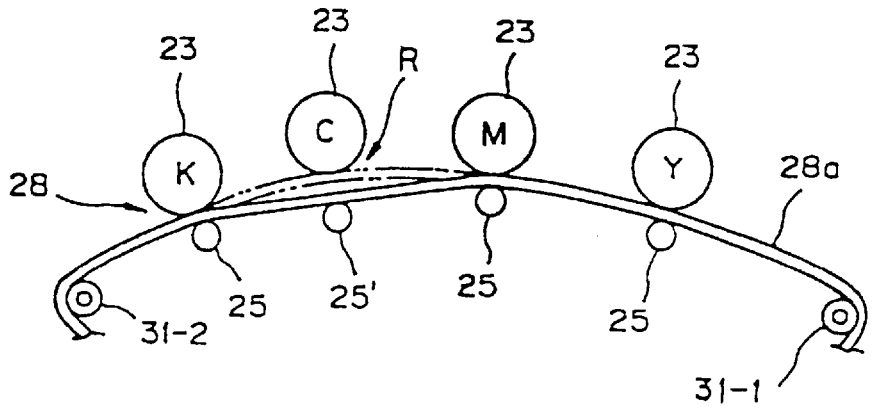
FIG. 6 is a diagram showing the paper transport path and its vicinity in the color printing mechanism engine of the first embodiment.

FIGS. 5 and 6 are diagrams showing the paper transport path 28 and a vicinity thereof.

As shown in FIG. 5, the photoconductive bodies (transfer drums) 23 of the color printing units 21Y, 21M, 21C and 21K are arranged above the paper transport path 28, and four transfer rollers 25 are arranged below the paper transport path 28.

In other words, the paper transport path 28 is formed by a transport belt 28*a* which transports the paper, and this transport belt 28*a* is wound in an endless manner around the outer peripheries of support rollers 31-1 and 31-2 and tension applying rollers (tension rollers) 32-1 and 32-2. The four photoconductive bodies 23 are arranged on the outer side above the transport belt 28*a*, and the four transfer rollers 25 are arranged on the inner side of the transport belt 28*a* at positions confronting the four corresponding photoconductive bodies 23. The rollers 32-1 and 32-2 apply tension in directions towards the outer side of the transport belt 28*a*, that is, in a direction a shown in FIG. 5 in the case of the roller 32-1 and a direction b shown in FIG. 5 in the case of the roller 32-2, by a spring mechanism or the like which is not shown, so as to absorb the redundancy of the transport belt 28*a*.

Each roller 25 is constructed to move downwards by a distance L shown in FIG. 5, for example, in response to the switching operation of the corresponding one of the switching mechanisms 26Y, 26M, 26C and 26K. FIG. 6 shows the lowered transfer roller by a reference numeral 25'.

Actually, the transfer rollers 25 are arranged so that the upper portion of the endless transport belt 28*a* has a gradual arcuate shape. When the transfer roller 25 assumes the lowered position indicated by 25' in FIG. 6, a portion R of the transport belt 28*a* in contact with the transfer roller 25 moves downwards as indicated by a solid line due to the tension of the transport belt 28*a*, and the photoconductive drum 23 confronting the lowered transfer roller 25' assumes the receded state separated from the paper transport path 28. In this receded state, the color printing unit 21C confronting the lowered transfer roller 25' does not make direct contact with the printing paper in FIG. 6. However, in FIG. 6, the photoconductive bodies 23 and the transfer rollers 25 are shown in an exaggerated arrangement to show the transport belt 28*a* with an exaggerated arcuate shape, in order to more clearly show that the transport belt 28*a* has the arcuate shape.

When the lowered transfer roller 25' is raised, the lowered portion R of the transport belt 28*a* moves up to its original position. As a result, the photoconductive drum 23 confronting the raised transfer roller 25 assumes the returned state where this photoconductive drum 23 makes direct contact with the transport belt 28*a*, that is, makes direct contact with the paper. In the returned state, the color printing unit carries out the printing with respect to the printing paper.

A more specific description will now be given of the construction of the switching mechanisms 26Y, 26M, 26C and 26K and the switching operation (raising and lowering operation) of the transfer rollers 25 by each of the switching mechanisms 26Y, 26M, 26C and 26K, by referring to FIG. 7.

Figure 7:
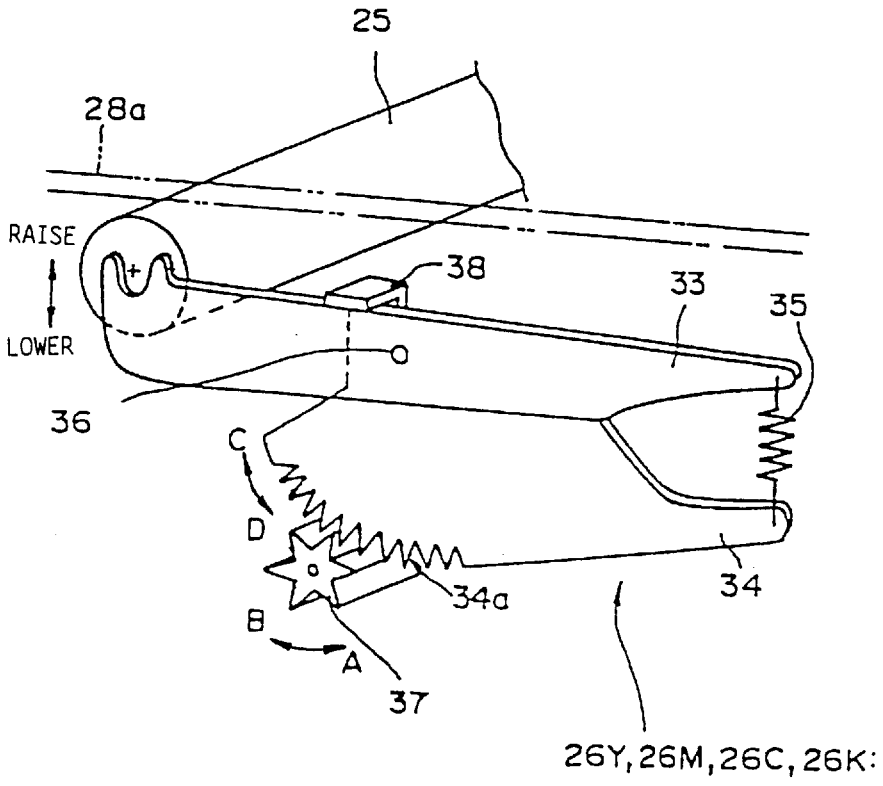
FIG. 7 is a diagram for explaining a transfer roller switching operation of the switching mechanism in the first embodiment.

As shown in FIG. 7, each of the switching mechanisms 26Y, 26M, 26C and 26K which raises and lowers the transfer roller 25 of the corresponding one of the color printing units 21Y, 21M, 21C and 21K has a mechanism which includes an upper lever 33, a lower lever 34, a spring 35 and a driving gear 37, on both sides of the transfer roller 25.

The upper lever 33 and the lower lever 34 are mounted on a main body of the color printer 5 in a state where the upper lever 33 and the lower lever 34 are linked by a connecting pin 36 in a mutually pivotable manner. One end of the upper lever 33 rotatably supports one end of the transfer roller 25.

In addition, the other end of the upper lever 33 and one end of the lower lever 34 are linked via the spring 35. This spring 35 applies an urging force in a direction such that the transfer roller 25 pushes against the photoconductive drum 23. Hence, when the printing paper is transported between the photoconductive drum 23 and the transfer roller 25 along the transport belt 28*a*, the upper lever 33 pivots about the connecting pin 36 against the urging force of the spring 35 and the transfer roller 25 is slightly lowered, so that it is possible to absorb the thickness of the paper.

A stopper 38 is formed on the lower lever 34. This stopper 38 is formed at a position between the connecting pin 36 and the spring 35 so that the stopper 38 makes contact with the top surface of the upper lever 33. The pivoting of the upper lever 33 due to the urging force of the spring 35 is restricted when the upper lever 33 makes contact with the stopper 38, and the transfer roller 25 is suppressed from being excessively pushed against the photoconductive drum 23.

The lower outer edge of the lower lever 34 has an arcuate shape about the connecting pin 36. A rack 34*a* which engages the driving gear 37 is formed on this arcuate lower outer edge.

The driving gear 37 is rotated in a direction A or B by a pulse motor which is not shown. The transfer roller 25, the upper lever 33, the lower lever 34 and the spring 35 as a whole turn about the connecting pin 36 in a direction C or D due to the rotational driving force of the driving gear 37, and the transfer roller 25 is raised or lowered responsive to this turn.

When the driving gear 37 rotates in the direction B in any of the switching mechanisms 26Y, 26M, 26C and 26K, the lower lever 34 pivots in the direction D, and the upper lever 33 also pivots in the direction D while making contact with the stopper 38. As a result, the transfer roller 25 is lowered to separate from the photoconductive drum 23, and the corresponding one of the color printing units 21Y, 21M, 21C and 21K assumes the receded state.

On the other hand, when the driving gear 37 rotates in the direction A in any of the switching mechanisms 26Y, 26M, 26C and 26K, the lower lever 34 pivots in the direction C, and the upper lever 33 also pivots in the direction C while receiving the urging force of the spring 35. As a result, the transfer roller 25 is raised, and the corresponding one of the color printing units 21Y, 21M, 21C and 21K assumes the returned state when the transfer roller 25 is raised to a predetermined position where the transfer roller 25 pushes against the photoconductive drum 23 with an appropriate pushing force.

When a desired transfer roller 25 is lowered by the switching operation of the corresponding one of the switching mechanisms 26Y, 26M, 26C and 26K, a desired one of the color printing units 21Y, 21M, 21C and 21K is set to the receded position where the photoconductive drum 23 of the desired color printing unit does not make direct contact with the printing paper. Further, when the lowered transfer roller 25 is raised to its original position, the desired one of the color printing units 21Y, 21M, 21C and 21K is set to the returned position where the photoconductive drum 23 of the desired color printing unit makes direct contact with the printing paper in order to carry out the printing.

Figure 8:
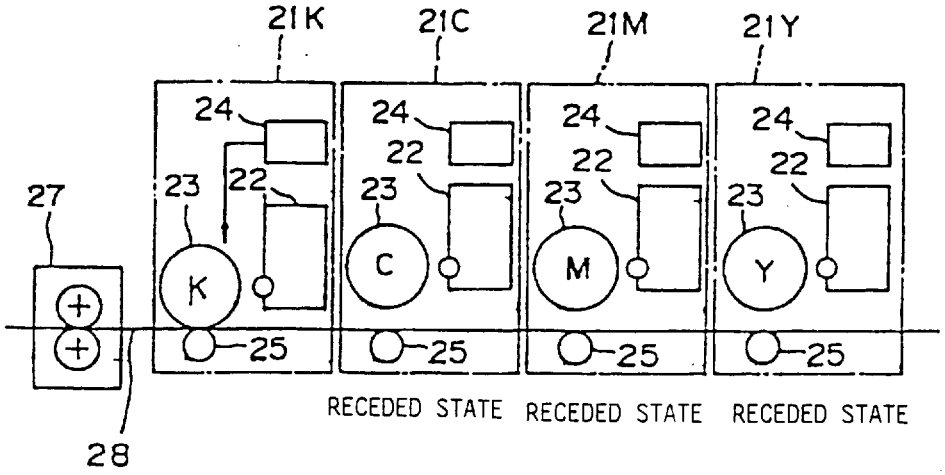
FIG. 8 is a diagram for explaining a recede/return operation of a color printing unit of the first embodiment.
Figure 9:
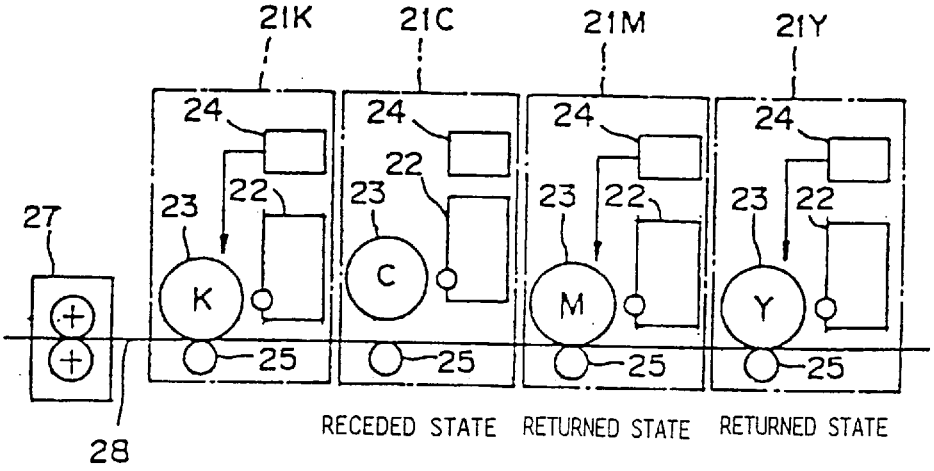
FIG. 9 is a diagram for explaining the recede/return operation of the color printing unit of the first embodiment.

If the color printing units 21Y, 21M, 21C and 21K are shown schematically when the above recede/return operation is carried out, the color printing units 21Y, 21M, 21C and 21K become as shown in FIG. 8 when the recede operation is carried out, and the color printing units 21Y, 21M, 21C and 21K become as shown in FIG. 9 when the return operation is carried out. In FIGS. 8 and 9, the receded state is shown in a state where the developing unit 22, the photoconductive drum 23 and the optical unit 24 are raised, but in this embodiment, the receded state is actually realized by lowering the transfer roller 25.

The developing unit 22 and the photoconductive drum 23 of the receded one of the color printing units 21Y, 21M, 21C and 21K are separated from the paper transport path 28. Hence, even at the time of the printing, it is unnecessary to agitate the developing agent of the developing unit 22 and it is unnecessary to rotate the photoconductive drum 23 of the receded color printing unit. For this reason, it is possible to prevent wear of the photoconductive drum 23 of the color printing unit which is not used frequently, and it is possible to prevent deterioration of the developing agent used in the color printing unit which is not used frequently. Consequently, it is possible to extend the serviceable life of the color printing unit which is not used frequently.

The control of the switching mechanisms 26Y, 26M, 26C and 26K which carry out the recede/return switching operation with respect to the color printing units 21Y, 21M, 21C and 21K is made by the color printing unit controller 15 of the control unit 10, based on various information from the data processor 11 and the panel controller 13 of the control unit 10.

FIG. 10 shows the flow of the various information related to the recede/return of the color printing units 21Y, 21M, 21C and 21K.

As shown in FIG. 10, the using-color information from the host interface 30 is converted into one of page color information, job/file color information and overlay color information by the data processor 11 of the control unit 10, and is input to the color printing unit controller 15 together with the print data.

The information input by the operator from the operation panel 29 is converted into recede/return operation mode information, recede timing page number information or operator recede/return instruction information by the panel controller 13 depending on the input information, and is input to the color printing unit controller 15.

Furthermore, the color printing unit controller 15 outputs to the print controller 16 recede color printing unit information obtained from the various information described above that is input to the control unit 10.

Figure 11:
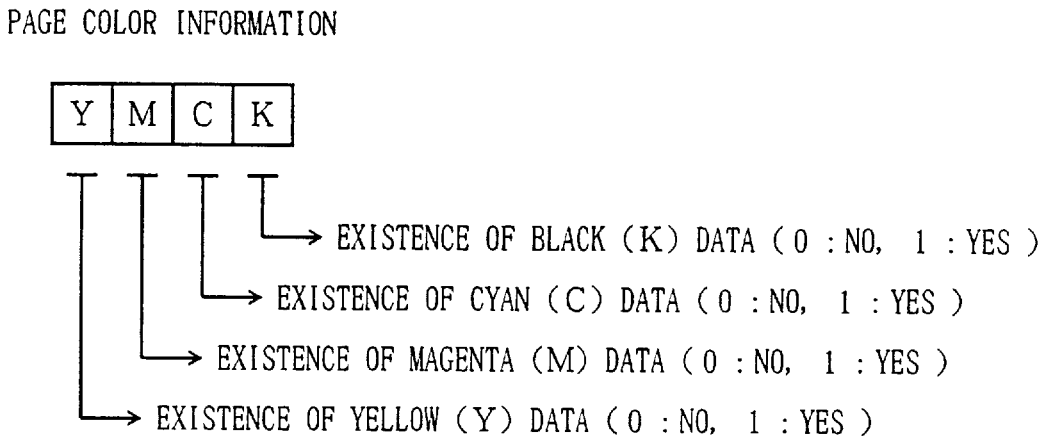
FIG. 11 is a diagram showing page color information of the first embodiment.

The page color information is the using-color information for each page used in the first mode. As shown in FIG. 11, the page color information is a 4-bit data indicating whether or not the data corresponding to each of the colors yellow (Y), magenta (M), cyan (C) and black (K) exists for each page, and the data "0" indicates that no data of the corresponding color exists and the data "1" indicates that the data of the corresponding color exists.

Figure 12:
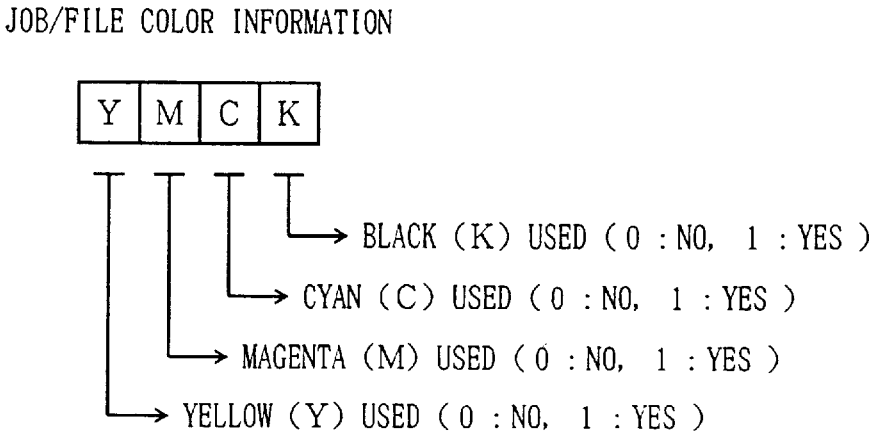
FIG. 12 is a diagram showing job/file color information of the first embodiment.

The job/file color information is the using-color information in units of jobs or in units of files used in the second mode. As shown in FIG. 12, the job/file color information is a 4-bit data indicating whether or not each of the colors yellow (Y), magenta (M), cyan (C) and black (K) is used in the units of jobs or the units of files, and the data "0" indicates that the corresponding color is not used and the data "1" indicates that the corresponding data is used.

The overlay color information is the color information of the overlay used in the fourth mode. An overlay printing refers to a printing wherein rules having a predetermined format such as the rules of a form sheet are printed in advance, and the character data are printed over the printed rules. The rules having the predetermined format will be referred to as the overlay.

Figure 13:
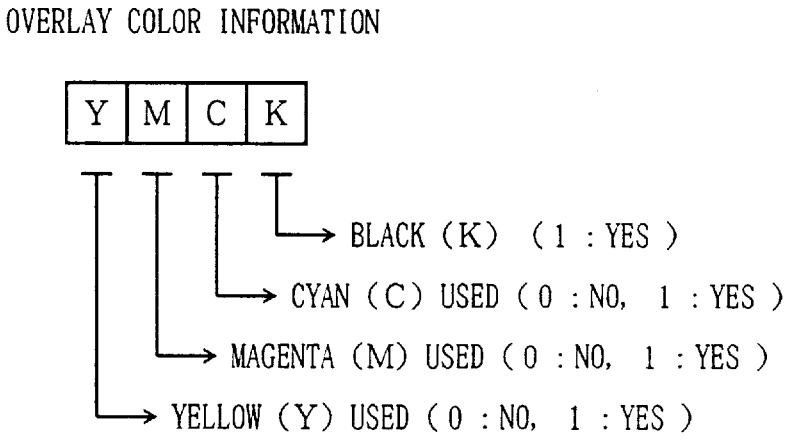
FIG. 13 is a diagram showing overlay color information of the first embodiment.

As shown in FIG. 13, the overlay color information is a 4-bit data indicating whether or not each of the colors yellow (Y), magenta (M), cyan (C) and black (K) is used, and the data "0" indicates that the corresponding color is not used and the data "1" indicates that the corresponding color is used. In the case of the overlay printing, the character data are normally printed in black. Thus, in the case shown in FIG. 13, the data "1" is fixedly set for the bit corresponding to black (K) so that black (K) is always used, but it is of course possible to omit the bit corresponding to black (K) in this case.

Figure 14:
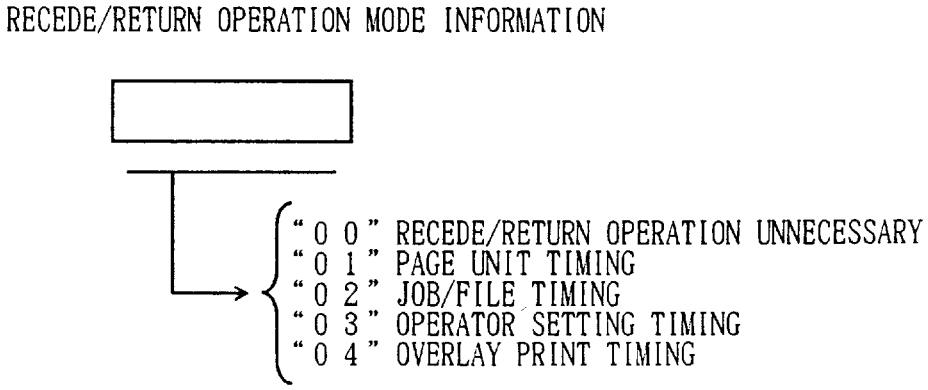
FIG. 14 is a diagram showing recede/return operation mode information of the first embodiment.

The recede/return operation mode information is set and input from the operation panel 29, and sets one of the first through fourth modes in which the recede/return operation of the color printing units 21Y, 21M, 21C and 21K is to be carried out. As shown in FIG. 14, a case where the recede/return operation is unnecessary is indicated by the data "00", and cases where the recede/return operation is necessary are indicated by the data "01" through "04".

The data "01" indicates the page unit timing recede/return process mode (first mode) in which the recede/return operation is carried out in units of pages. The data "02" indicates the job/file timing recede/return process mode (second mode) in which the recede/return operation is carried out in units of jobs/files. The data "03" indicates the operator setting timing recede/return process mode (third mode) in which the recede/return operation which is arbitrarily set by the operator is carried out. The data "04" indicates the overlay print timing recede/return process mode (fourth mode) in which the recede/return operation dependent on the overlay printing is carried out.

The recede timing page number information is set and input from the operation panel 29, and is used in the first mode. In other words, the recede timing page number information is the page number information that is used when the recede/return operation of the color printing units 21Y, 21M, 21C and 21K is carried out. As shown in FIG. 15, the recede timing page number, that is, the prescribed number of pages, is set with respect to each of the color printing units 21Y, 21M, 21C and 21K corresponding to the colors yellow (Y), magenta (M), cyan (C) and black (K), and a flag is "0" when the recede control is unnecessary and the flag is "1" when the recede control is necessary.

Actually, the recede operation of each of the color printing units 21Y, 21M, 21C and 21K is carried out in units of the number of pages amounting to 500 to 1000 pages. The counting of the number of pages with respect to each of the colors is made by a yellow (Y) page number counter, a magenta (M) page number counter, a cyan (C) page number counter and a black (K) page number counter (not shown) which are formed by software in the color printing unit controller 15.

The operator recede/return instruction information is set and input from the operation panel 29, and is used in the third mode. This operator recede/return instruction information indicates the recede instruction which is arbitrarily set by the operator with respect to each of the color printing units 21Y, 21M, 21C and 21K. As shown in FIG. 16, a case where no recede instruction is given is indicated by "0", and a case where the recede instruction is given is indicated by "1".

In addition, the receding color printing unit information is obtained from the color printing unit controller 15 based on the various information described above and output to the print controller 16. This receding color printing unit information indicates the color printing unit which is to recede. As shown in FIG. 17, with respect to each of the color printing units 21Y, 21M, 21C and 21K, "0" indicates that the color printing unit is to set to the returned state, and "1" indicates that the color printing unit is to be set to the receded state.

A description will now be given of the operation of the color printer 5, that is, this embodiment of the image forming apparatus of the present invention, by referring to the flow charts shown in FIGS. 18 through 23.

Figure 18:
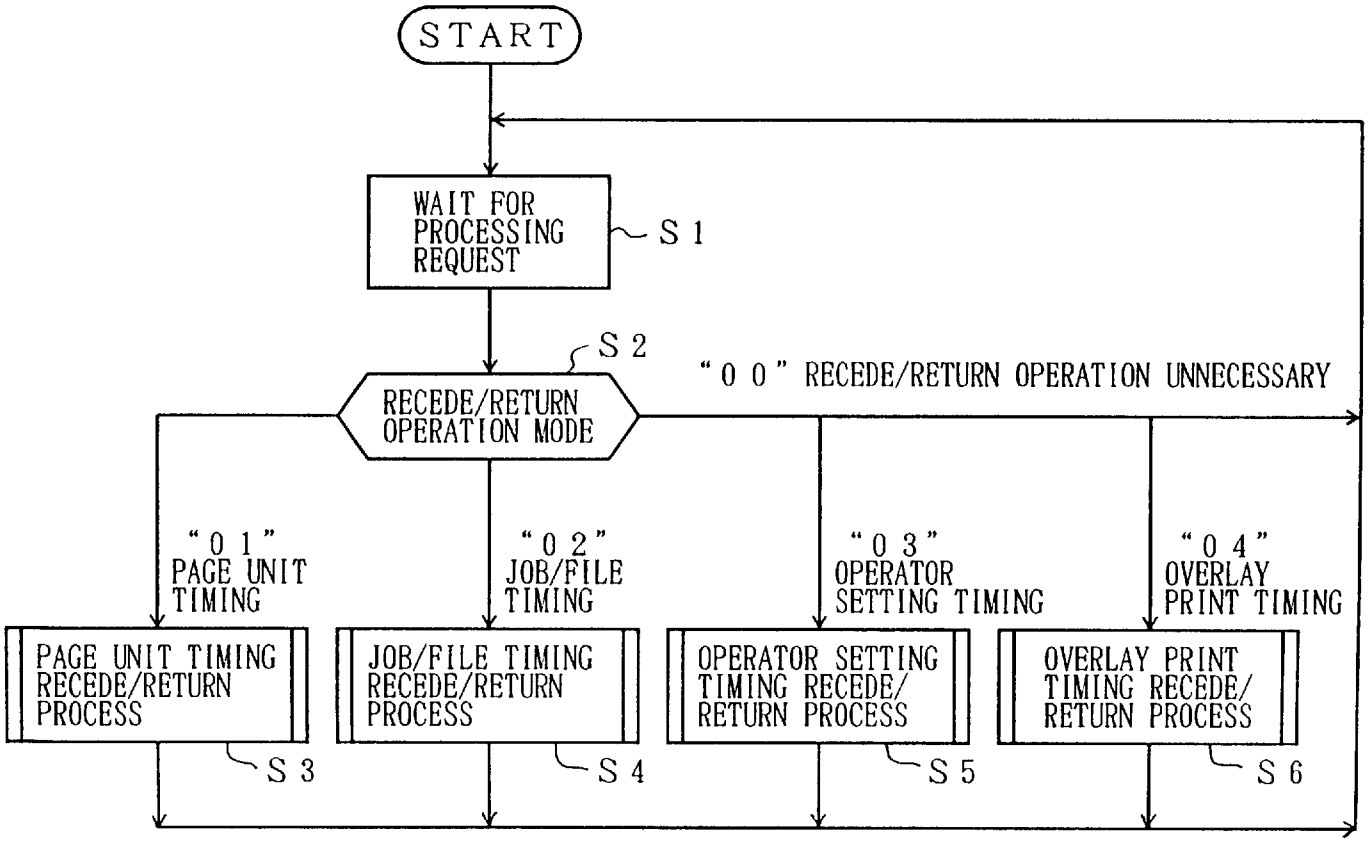
FIG. 18 is a flow chart for generally explaining a process of the color printing unit of the color printer in the first embodiment.

FIG. 18 generally shows the process carried out by the color printing unit controller 15 of the color printer 5.

IN a step S1, the color printing unit controller 15 is in a waiting state until the operator newly inputs or changes the recede/return operation mode information from the operation panel 29 via the panel controller 13. When the recede/return operation mode information is input or changed, the color printing unit controller 15 judges whether the recede/return operation mode information is "00 ", "01", "02", "03" or "04" in a step S2.

If the input recede/return operation mode information is "00" which indicates that the recede/return operation is unnecessary, the color printing unit controller 15 returns to the step S1 and assumes the waiting state waiting for a process request.

On the other hand, if the recede/return operation mode information is one of "01" through "04", the color printing unit controller 15 moves to a page unit timing recede/return process (first mode) in a step S3, a job/file timing recede/return process (second mode) in a step S4, an operator setting timing recede/return process (third mode) in a step S5 or an overlay print timing recede/return process (fourth mode) in a step S6, depending on whether the information is "01", "02", "03" or "04". Thereafter, the color printing unit controller 15 again assumes the waiting state by returning to the step S1.

Accordingly, by making it possible for the operator to select, from the outside, the recede/return operation timing from one of the first through fourth modes, it becomes possible to carry out optimum recede/return operations of the color printing units 21Y, 21M, 21C and 21K with respect to the various printing operations while securing the desired printing performance.

A more detailed description will be given with respect to the first through fourth modes described above, by referring to FIGS. 19 through 23.

First, a description will be given of the page unit timing recede/return process carried out by the step S3 shown in FIG. 18, as the first mode, with reference to FIGS. 19 and 20.

Figure 19:
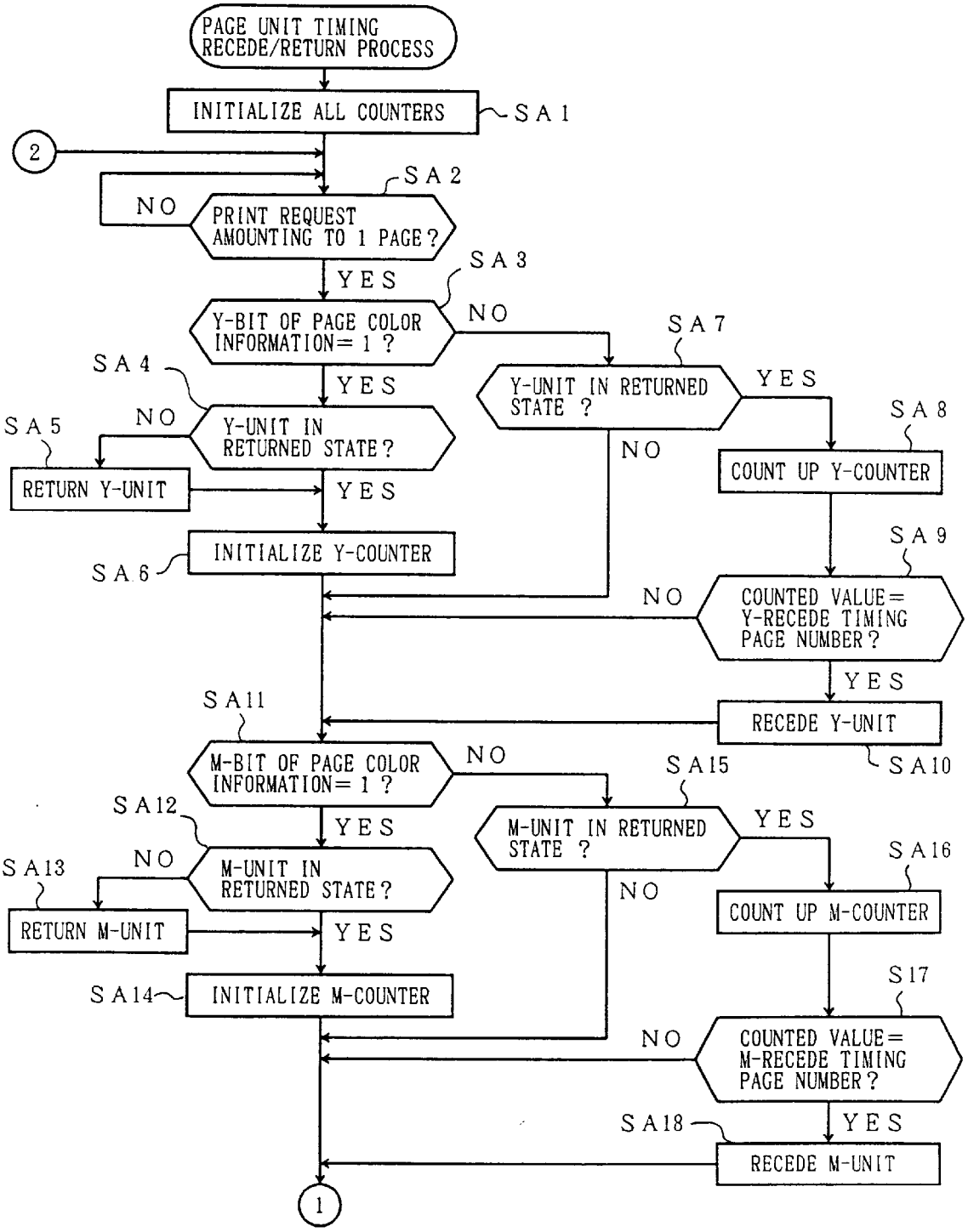
FIG. 19 is a flow chart for explaining a page unit timing recede/return process as a first mode of the first embodiment.

When the page unit timing recede/return process mode is set, the color printing unit controller 15 first initializes all of the counters (that is, the yellow (Y) page number counter, the magenta (M) page number counter, the cyan (C) page number counter and the black (K) page number counter in a step SA1 shown in FIG. 19.

Next, a decision is made to determine whether or not a print request amounting to one page exists in a step SA2. If no print request exists, a print request is waited until received. On the other hand, if the print request exists, a decision is made to determine whether or not the Y-bit of the page color information is "1" in a step SA3.

If the Y-bit of the page color information is "1", a decision is made to determine whether or not a decision is made to determine whether or not the yellow (Y) color printing unit 21Y (hereinafter also referred to as a Y-unit, and the magenta (M), cyan (C) and black (K) color printing units 21M, 21C and 21K are hereinafter also referred to as a M-unit, a C-unit and a K-unit) is in the returned state in a step SA4. If the Y-unit is not in the returned state, the Y-unit is returned in a step SA5 and the Y-page number counter is initialized in a step SA6.

On the other hand, if the Y-bit of the page color information is not "1", a decision is made to determine whether or not the Y-unit is in the returned state in a step SA7. If the Y-unit is in the returned state, the Y-page number counter is incremented by one in a step SA8, and the counted value of the Y-page number counter and a Y-recede timing page number are compared in a step SA9. If the counted value of the Y-page number counter matches the Y-recede timing page number, the Y-unit is controlled to recede in a step SA10.

Figure 20:
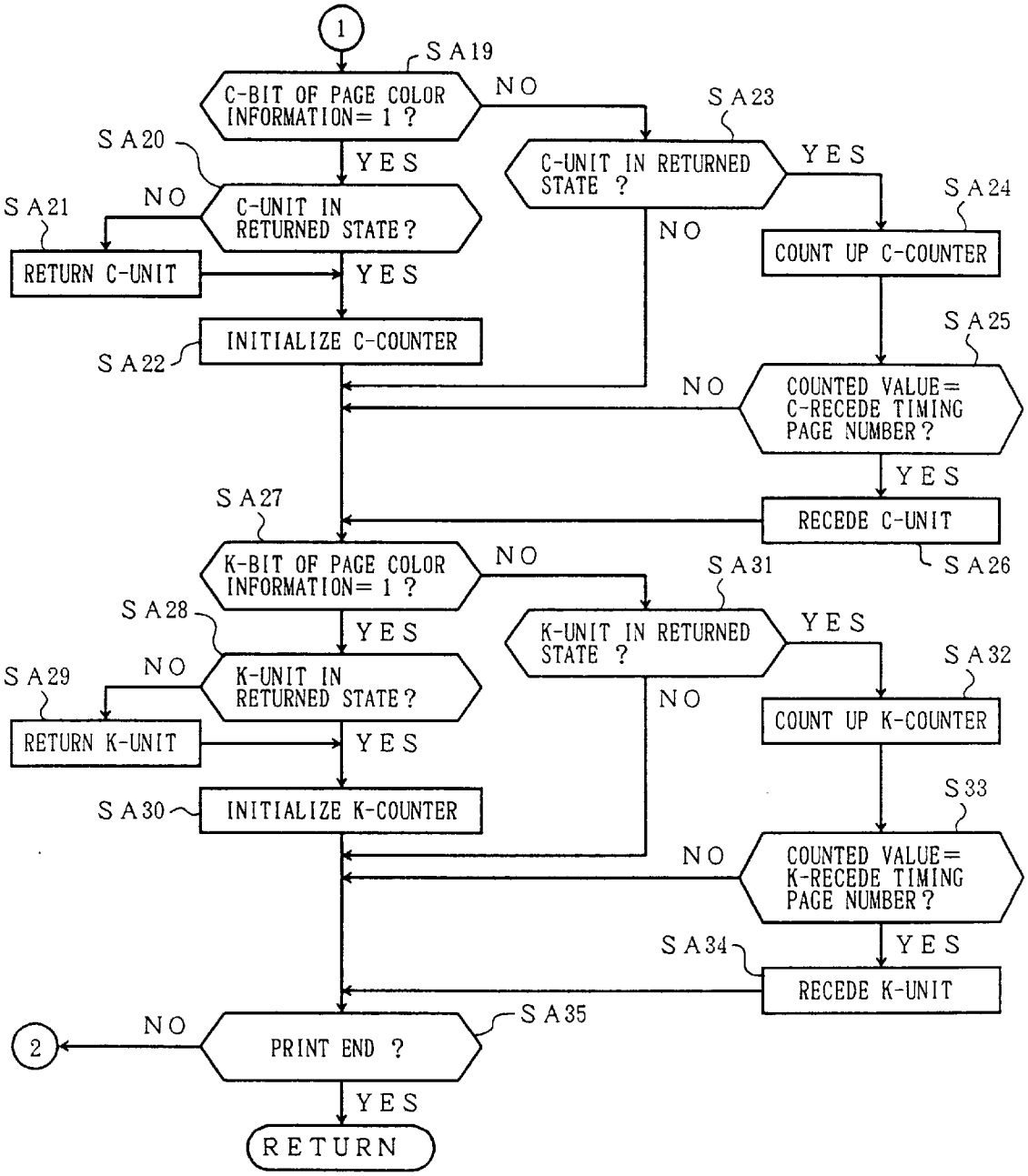
FIG. 20 is a flow chart for explaining the page unit timing recede/return process as the first mode of the first embodiment.

The above described operation of the steps SA3 through SA10 is similarly carried out with respect to each of the M-unit in steps SA11 through SA18 shown in FIG. 19, the C-unit in steps SA19 through SA26 shown in FIG. 20, and the K-unit in steps SA27 through SA34 shown in FIG. 20. Finally, a decision is made to determine whether or not the printing has ended in a step SA35.

Accordingly, when printing the prescribed number of pages which is 1000 pages, for example, it is possible to independently control each of the color printing units 21Y, 21M, 21C and 21K which is not used so as to recede, and to independently control each of the color printing units 21Y, 21M, 21C and 21K to return when a page needs to be printed using the corresponding color which was previously not used. In other words, it is possible to carry out the recede/return operation of each of the color printing units 21Y, 21M, 21C and 21K in units of a predetermined number of pages which is variable.

In this embodiment, the number of pages of the recede timing can be set for each of the color printing units 21Y, 21M, 21C and 21K depending on the frequency of use of each of the printing colors. For this reason, it is possible to carry out the recede/return operation of each of the color printing units 21Y, 21M, 21C and 21K that suits the printing operation while securing the desired printing performance.

Next, a description will be given of the job/file timing recede/return process carried out by the step S4 shorn in FIG. 18, as the second mode, by referring to FIG. 21.

When the job/file timing recede/return process mode is set, the color printing unit controller 15 decides whether or not the color printing units 21Y, 21M, 21C and 21K are to be used, based on the job/file color information. The color printing unit controller 15 outputs a recede instruction with respect to each corresponding one of the switching mechanisms 26Y, 26M, 26C and 26K provided for the color printing units 21Y, 21M, 21C and 21K which are not to be used.

Figure 21:
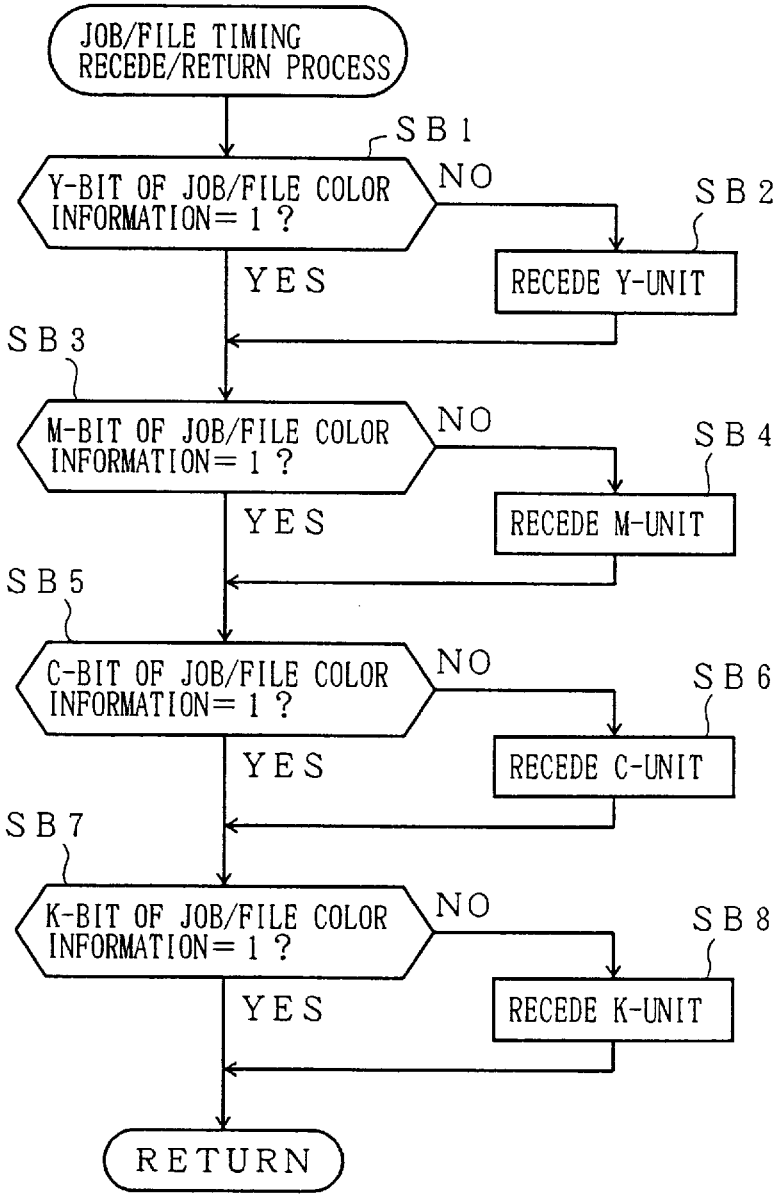
FIG. 21 is a flow chart for explaining a job/file timing recede/return process as a second mode of the first embodiment.

In other words, as shown in FIG. 21, the color printing unit controller 15 decides whether or not the Y-bit of the job/file color information is "1" in a step SB1, and controls the Y-unit to recede if the Y-bit of the job/file color information is not "1" in a step SB2. Similar operations are carried out with respect to each of the M-unit in steps SB3 and SB4, the C-unit in steps SB5 and SB6, and the K-unit in steps SB7 and SB8.

By the above described process, the Y-unit, the M-unit and the C-unit which are not used are switched to the receded states when carrying out a monochrome printing because only the K-unit is used in this case.

On the other hand, in the case of the color printing, the color printing unit to recede is controlled depending on the using-color information. For example, if the colors black and read are to be used, the K-unit for printing in black and the Y-unit and the M-unit for printing in red are used, and thus, only the C-unit is switched to the receded state. The color red is obtained by mixing the yellow and magenta printed by the Y-unit and the M-unit.

By deciding whether or not each of the color printing units 21Y, 21M, 21C and 21K is to be used based on the job/file color information, controlling each of the color printing units 21Y, 21M, 21C and 21K which is not used to assume the receded state, and carrying out the recede/return operation of the color printing units 21Y, 21M, 21C and 21K with the timing of the print job unit or the print file unit, it becomes possible to carry out the printing at a high speed as compared to the case where the recede/return operation is carried out in page unit and the desired printing performance can be secured.

Next, a description will be given of the operator setting timing recede/return process carried out by the step S5 shown in FIG. 18, as the third mode, by referring to FIG. 22. When the operator setting timing recede/return process mode is set, the color printing unit 15 decides whether or not the Y-bit of the operator recede/return instruction information is "1" in a step SC1. If the Y-bit of the operator recede/return instruction information is not "1", the Y-unit is controlled to recede in a step SC2. Similar operations are carried out with respect to the M-unit in steps SC3 and SC4, the C-unit in steps SC5 and SC6, and the K-unit in steps SC7 and SC8.

Accordingly, when the operator sets from the outside the colors to be used or the colors not to be used, that is, the color printing units to be used or the color printing units not to be used, via the operation panel 29 and controls each of the color printing units 21Y, 21M, 21C and 21K which is to recede based on the set information, it becomes possible to carry out the recede/return operation suite for the printing operation while securing the desired printing performance.

In addition, this third mode can be used to forcibly recede each of the color printing units 21Y, 21M, 21C and 21K which cannot be used by specifying the unit from the outside by the operator or the like when one of the color printing units 21Y, 21M, 21C and 21K fails or, the toner or developing agent of one of the color printing units 21Y, 21M, 21C and 21K runs out. As a result, it is possible to continue the printing operation using those one of the color printing units 21Y, 21M, 21C and 21K which can be used, without stopping the printing operation.

Finally, a description will be given of the overlay print timing recede/return process which is carried out by the step S6 shown in FIG. 18, as the fourth mode, by referring to FIG. 23.

In the case of the overlay printing, the K-unit is always used when printing the characters. Hence, in the overlay print timing recede/return process, the recede/return operations of the Y-unit, the M-unit and the K-unit are carried out.

First, when the overlay print timing recede/return process mode is set, the color printing unit controller 15 decides whether or not the Y-bit of the overlay color information is "1" in a step SD1, and the Y-unit is controlled to recede if the Y-bit of the overlay color information is not "1" in a step SD2. Similar operations are carried out with respect to the M-unit in steps SD3 and SD4, and the C-unit in steps SD5 and SD6.

Therefore, in the case of the overlay printing in which frequency color printing is predictable, each of the color printing units 21Y, 21M, 21C and 21K which is not used is judged from the overlay color information, and the recede/return operation of each of the color printing units 21Y, 21M, 21C and 21K that is not used at the time of the overlay printing is carried out. As a result, it is ossible to carry out the recede/return operation which is suited for the printing operation, while securing the desired printing performance.

The timing with which the recede/return operation of each of the color printing units 21Y, 21M, 21C and 21K is carried out may be the time when the predetermined unused condition of one of the first through fourth modes is satisfied, instead of the timing of each page. In this case, it is possible to greatly reduce the power consumption while securing the desired printing performance. In addition, it is possible to extend the serviceable lives of each of the color printing units 21Y, 21M, 21C and 21K which is not used frequently and the developing agent thereof. Furthermore, it is possible to positively prevent the toner of the unused color from adhering onto the paper as stain, and the printing quality can be improved.

On the other hand, since the operator can select the recede/return operation timing to one of the first through fourth modes from the outside, it is possible to carry out the recede/return operation of each of the color printing units 21Y, 21M, 21C and 21K that is optimized with respect to the various printing operations, while securing the desired printing performance.

The transport belt may be made of a thin film material, and transports the medium such as paper in a state where the medium is electrostatically adhered on the thin film material. However, the strength of this material forming the transport belt is relatively weak, and the durability of this material is relatively poor with respect to stress such as distortion caused by external forces, tear, and damage caused by friction. For this reason, if the transport belt repeats the above described recede/return operation with respect to each photoconductive drum and the engagement/disengagement of the transport belt and each photoconductive drum is repeated, the transport belt is particularly vulnerable to damage, and the serviceable life of the transport belt becomes relatively short. Accordingly, a description will hereinafter be given of an embodiment of the image forming apparatus which can extend the serviceable life of the transport belt by minimizing mutual damage to the transport belt and each photoconductive drum upon engagement/disengagement of the transport belt and each photoconductive drum.

Figure 24:
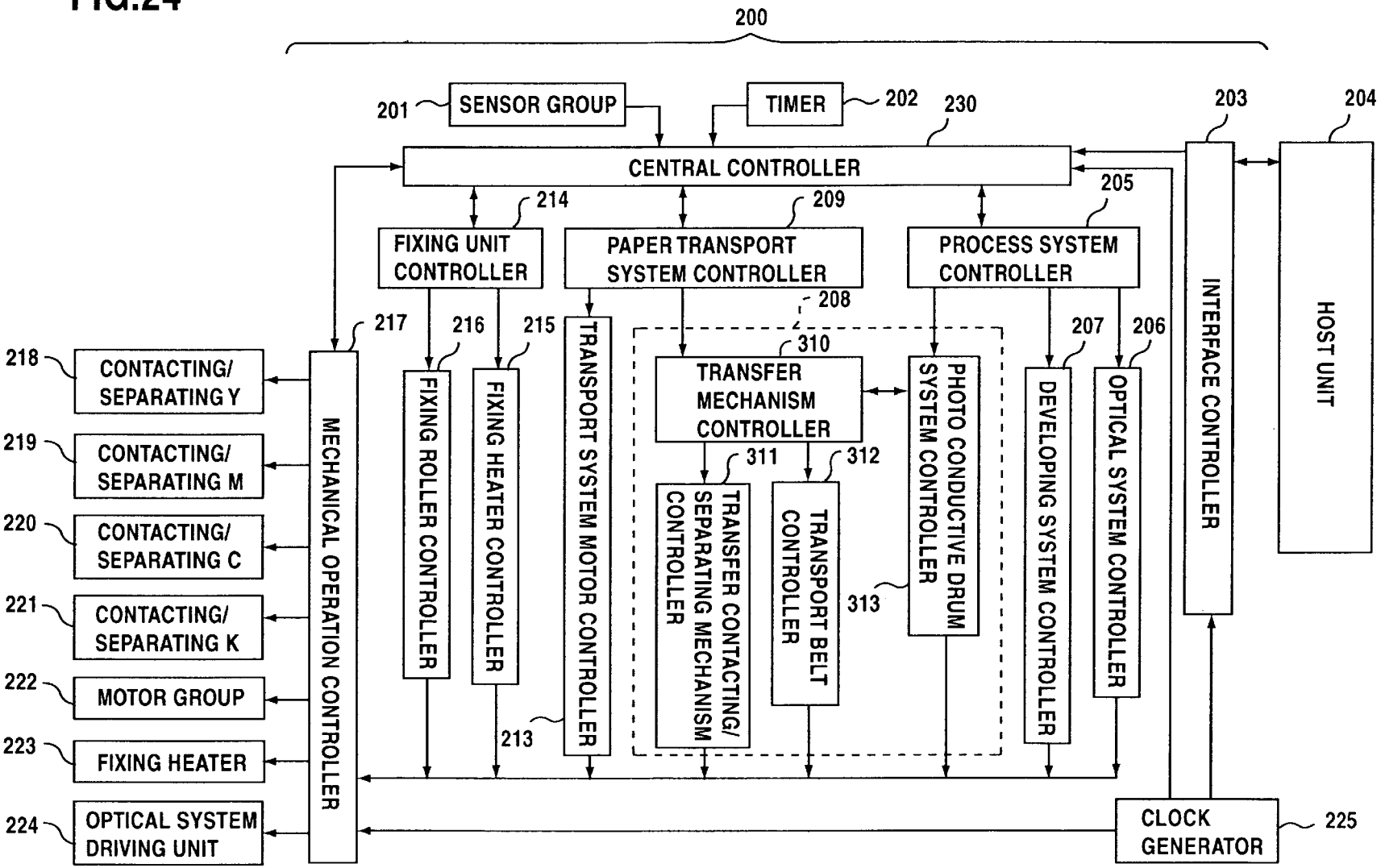
FIG. 24 is a system block diagram showing a part of a second embodiment.

FIG. 24 is a system block diagram showing a part of a color printer as a second embodiment of the image forming apparatus according to the present invention. In FIG. 24, a printer part 200 corresponds to the control unit 10 of the first embodiment shown in FIG. 4, and a host unit 204 corresponds to the host interface 30 shown in FIG. 4.

The printing part 200 generally includes a sensor group 201 made up of various sensors, a timer 202, an interface controller 203, a process system controller 205, an optical system controller 206, a developing system controller 207, a print controller 208, a paper transport system controller 209, a transport system motor controller 213, a fixing unit controller 214, a fixing heater controller 215, a fixing roller controller 216, a mechanical operation controller 217, a clock generator 225, and a central controller 230.

The central controller 230 controls various parts of the printer part 20 based on instructions and image data obtained from the host unit 204 via the interface controller 203. The central controller 230 receives information from the sensor group 201 which is made up of a paper sensor, a temperature sensor and the like, and time information from the timer 202. In addition, the clock generator 225 generates various clock signals, and supplies the clock signals to the central controller 230, the interface controller 203, the mechanical operation controller 217 and the like.

The process system controller 205 controls the process systems of the color printer, that is, the color printing units, based on the instructions from the central controller 230. More particularly, the process system controller 205 controls the optical system controller 206 so as to control parts of the color printer related to the optical system such as an optical system driving unit 224 via the mechanical operation controller 217, and controls the developing system controller 207 so as to control parts of the color printer related to the developing system such as a motor of a motor group 222 via the mechanical operation controller 217. Furthermore, the process system controller 205 controls the print controller 208 together with the paper transport system controller 209.

The print controller 208 includes a transfer mechanism controller 310, a transfer contacting/separating mechanism controller 311, a transport belt controller 312, and a photoconductive drum system controller 313. The transfer mechanism controller 310 is controlled by the central controller 230 via the paper transport system controller 209, and controls the transfer contacting/separating mechanism controller 311, the transport belt controller 312 and the photoconductive drum system controller 313. The photoconductive drum system controller 313 is also controlled by the central controller 230 via the process system controller 205. The photoconductive drum system controller 313 controls motors which belong to the motor group 222 and respectively rotate the photoconductive drums of each of the color printing units. The transport belt controller 312 controls a motor which belongs to the motor group 222 and drives the transport belt. In addition, the transfer contacting/separating mechanism controller 311 independently controls Y-transfer contacting/separating motor 218, M-transfer contacting/separating motor 219, a C-transfer contacting/separating motor 220, and a K-transfer contacting/separating motor 221 of each of the color printing units. The Y, M, C and K transfer contacting/separating motors 218, 219, 220 and 221 drive mechanisms for contacting/separating the transport belt with respect to the corresponding Y, M, C and K color printing units. These mechanisms may have the same construction as those of the first embodiment described above.

The transport system motor controller 213 controls motors which belong to the motor group 222 and drive the duplex unit such as a paper reversing unit, the paper supply unit, the paper eject unit and the like, based on the instructions received from the central controller 230 via the paper transport system controller 209. In other words, the transport system motor controller 213 controls the motors of the motor group 222 other than the motor which drives the transport belt. The fixing heater controller 215 controls a heat generating quantity of the fixing heater 223 based on the instruction received from the central controller via the fixing controller 214. The fixing roller controller 216 controls a motor which belongs to the motor group 222 and drives the fixing roller, based on the instruction received from the central controller 230 via the fixing unit controller 214.

The operations of the various parts of the printer part 200 can be realized by one or a plurality of central processing units (CPUs) and a memory which stores data and programs to be executed by the CPU or CPUs. Accordingly, the operation of the print controller 208 can also be realized by one or more CPUs and a memory, for example.

Figure 25:
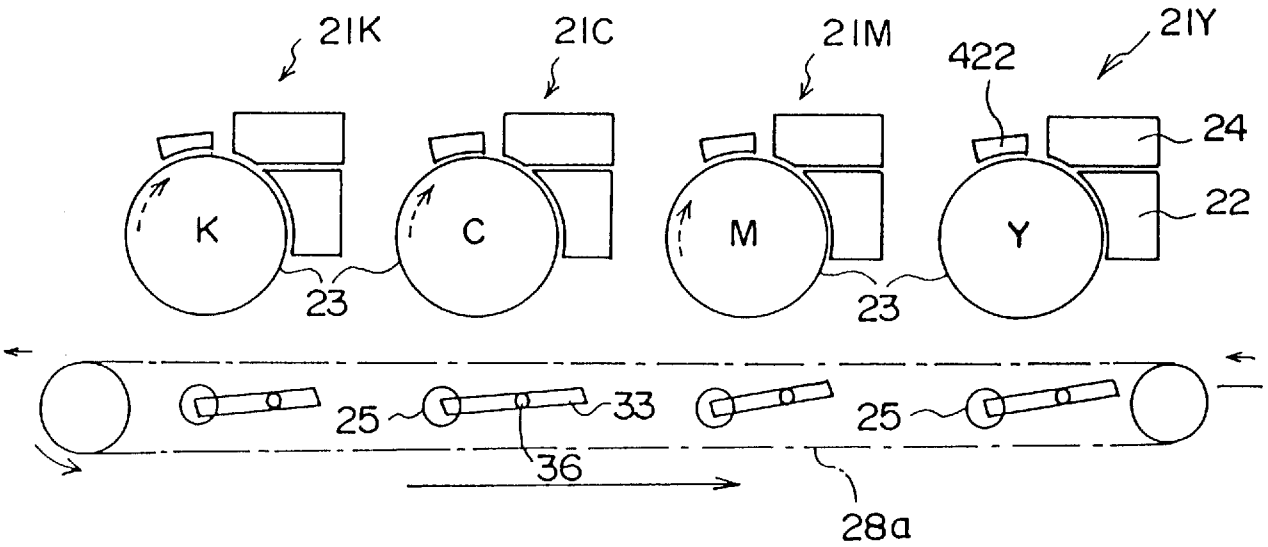
FIG. 25 is a diagram for explaining the operation of the second embodiment.
Figure 26:
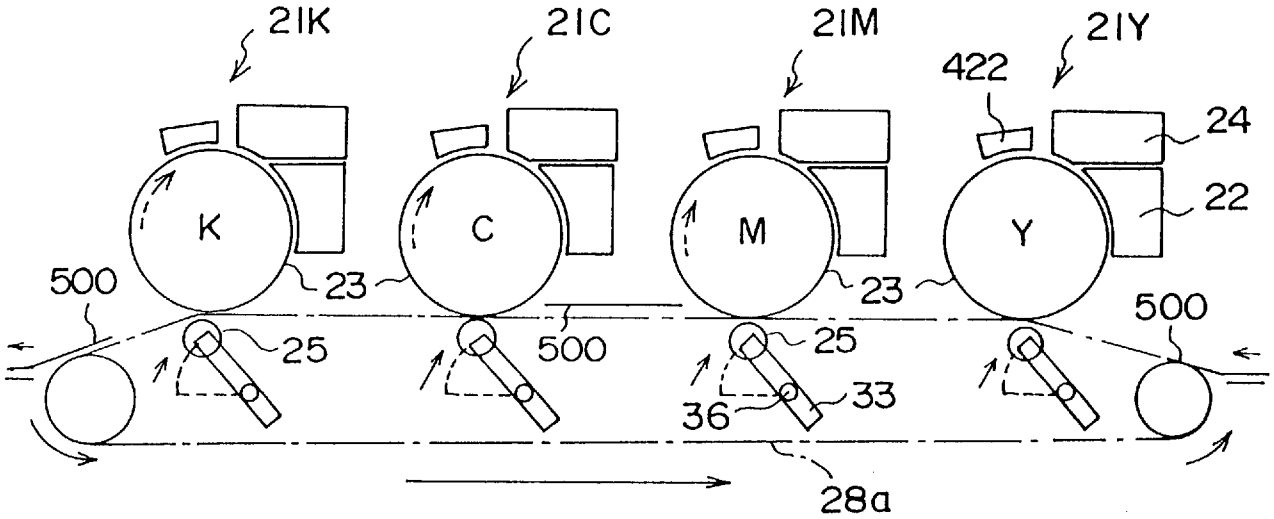
FIG. 26 is a diagram for explaining the operation of the second embodiment.

FIGS. 25 and 26 are diagrams for explaining the operation of this embodiment. FIG. 25 shows a state where the transport belt and the photoconductive drum of each of the color printing units are separated. On the other hand, FIG. 26 shows a state where the transport belt and the photoconductive drum of each of the color printing units are in contact. In FIGS. 25 and 26, those parts which are essentially the same as those corresponding parts in FIGS. 4 through 7 are designated by the same reference numerals, and a description thereof will be omitted.

In FIGS. 25 and 26, a precharger is denoted by a reference numeral 422. Each of the transfer rollers 25 are independently controlled by the print controller 208 with respect to the corresponding Y, M, C and K color printing units 21Y, 21M, 21C and 21K. However, for the sake of convenience, FIGS. 25 and 26 show all of the transfer rollers 25 as being separated from the corresponding Y, M, C and K color printing units 21Y, 21M, 21C and 21K. Other parts of the color printer may have the same construction as the first embodiment described above, and a description and illustration thereof will be omitted.

Figure 27:
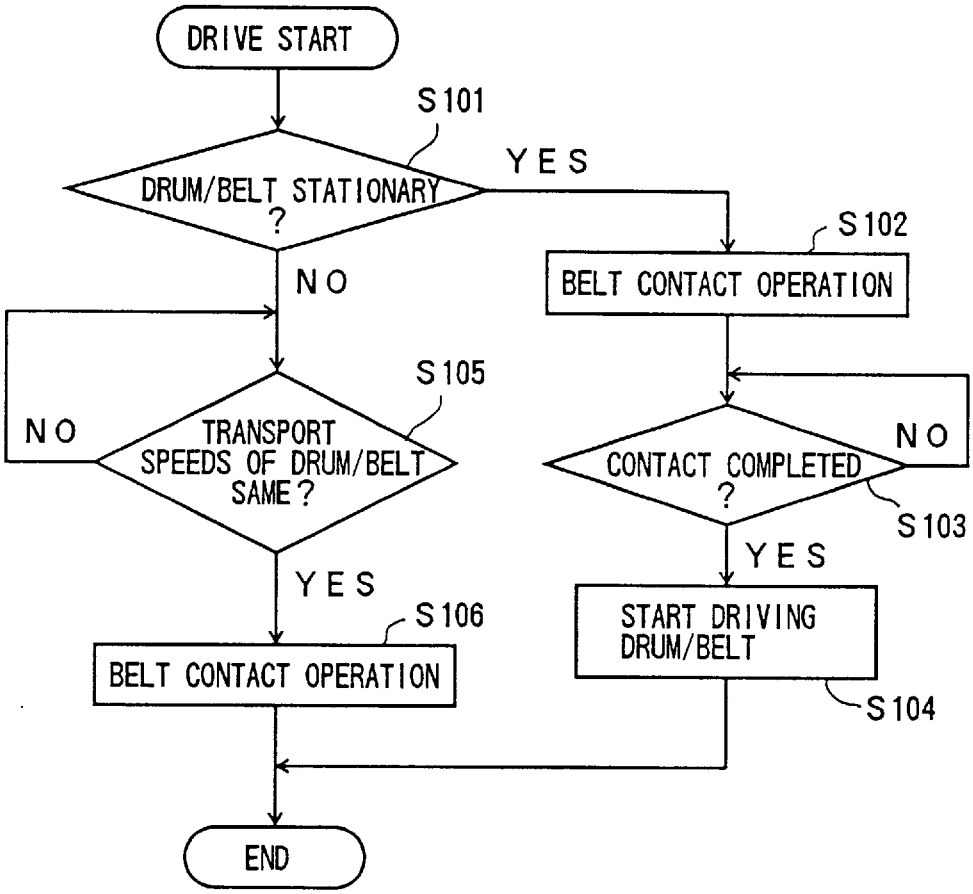
FIG. 27 is a flow chart for explaining the operation of the second embodiment.

FIG. 27 is a flow chart for explaining the operation of a CPU when the operation of the print controller 208 is realized by the CPU in this embodiment. In the following description, the return operation of the transport belt 28*a* with respect to one color printing unit will be described for the sake of convenience.

In FIG. 27, a step S101 decides whether or not the photoconductive drum 23 of the color printing unit or the transport belt 28*a* is stationary. It is possible to determine whether or not the photoconductive drum 23 is stationary by confirming whether or not the motor of the motor group 222 which drives the photoconductive drum 23 is being driven by the photoconductive drum system controller 313 within the print controller 208, that is, the CPU, for example. Similarly, it is possible to determine whether or not the transport belt 28*a* is stationary by confirming whether or not the motor of the motor group 222 which drives the photoconductive drum 23 is stationary by the transport belt controller 312 within the print controller 208, that is, the CPU.

If the decision result in the step S101 becomes YES, a step S102 drives the switching mechanism to control the color printing unit to the returned state, so that the transport belt 28*a* and the photoconductive drum 23 of the color printing unit make contact. A step S103 decides whether or not the contact of the transport belt 28*a* and the photoconductive drum 23 of the color printing unit is completed. If the decision result in the step S103 becomes YES, a step S104 starts to drive the photoconductive drum 23 and to drive the transport belt 28*a*, and the process ends.

On the other hand, if the decision result in the step S101 is NO, a step S105 decides whether or not the transport speed of the photoconductive drum 23 and the transport speed of the transport belt 28*a* are the same. If the decision result in the step S105 becomes YES, a step S106 drives the switching mechanism and controls the color printing unit to the returned state, similarly to the step S102 described above. As a result, the transport belt 28*a* and the photoconductive drum 23 of the color printing unit make contact, and the process ends. In this case, the photoconductive drum 23 and the transport belt 28*a* make contact in a state where the two are driven at the same transport speed. In other words, the rotational speed of the photoconductive drum 23, that is, the image transfer speed, and the transport speed with which the transport belt 28*a* transports a paper 500 are the same. Hence, the paper 500 is stably transported without slipping in a state where the paper 500 is pinched between the photoconductive drum 23 and the transport belt 28*a*.

The above described return process is carried out independently with respect to each of the color printing units in a manner similar to that described above.

Therefore, the transport belt 28*a* and the photoconductive drums 23 of each of the Y, M, C and K color printing units 21Y, 21M, 21C and 21K make contact only when the transport speeds of the photoconductive drums 23 and the transport speed of the transport belt 28*a* are the same. In other words, the transport belt 28*a* and each photoconductive drum 23 make contact only when the transport speeds of the two are the same or when both are stationary. For this reason, it is possible to minimize the mutual damage when the transport belt 28*a* and each photoconductive drum 23 make contact, and it is possible to particularly extend the serviceable life of the transport belt 28*a*.

Figure 28:
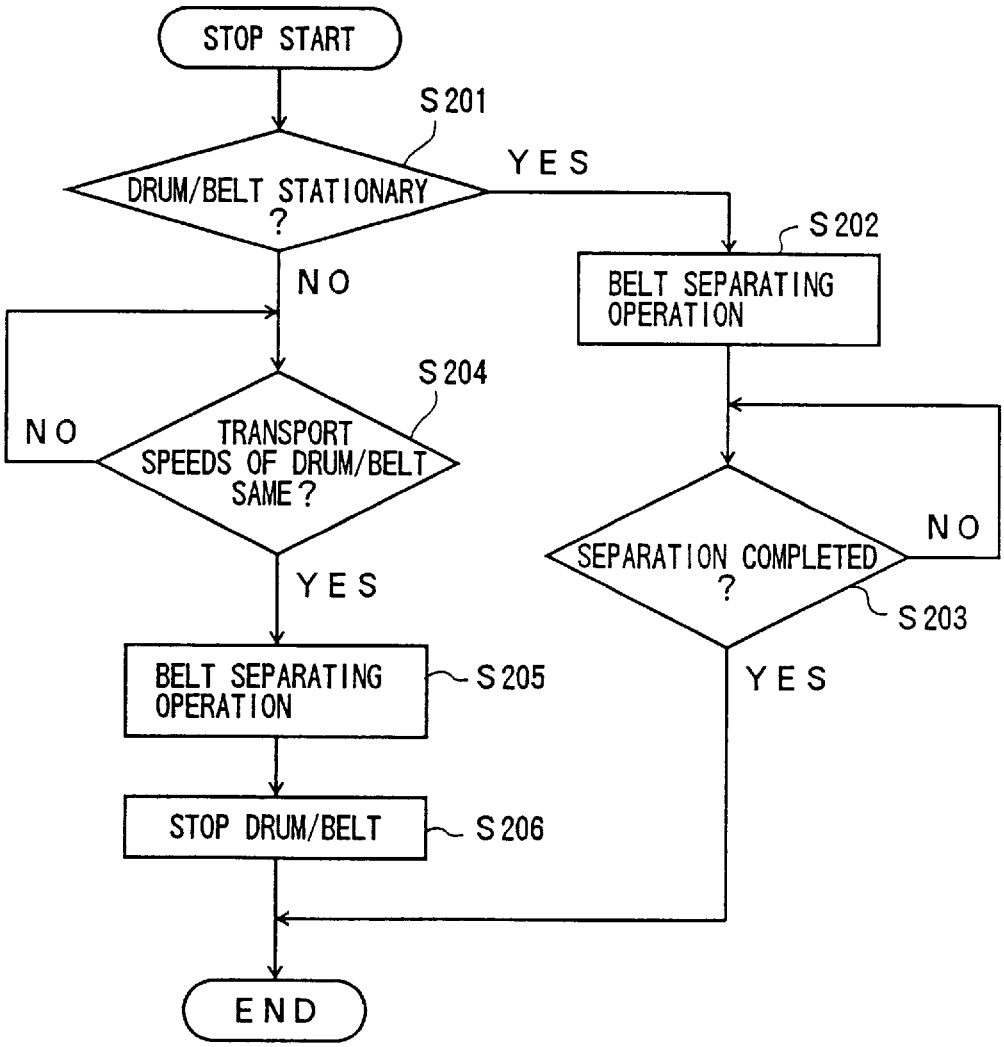
FIG. 28 is a flow chart for explaining the operation of the second embodiment.

FIG. 28 is a flow chart for explaining the operation of a CPU when the operation of the print controller 208 is realized by the CPU in this embodiment. In the following description, the recede operation of the transport belt 28*a* with respect to one color printing unit will be described for the sake of convenience.

In FIG. 28, a step S201 decides whether or not the photoconductive drum 23 of the color printing unit or the transport belt 28*a* is stationary. It is possible to determine whether or not the photoconductive drum 23 is stationary by confirming whether or not the motor of the motor group 222 which drives the photoconductive drum 23 is being driven by the photoconductive drum system controller 313 within the print controller 208, that is, the CPU, for example. Similarly, it is possible to determine whether or not the transport belt 28*a* is stationary by confirming whether or not the motor of the motor group 222 which drives the photoconductive drum 23 is stationary by the transport belt controller 312 within the print controller 208, that is, the CPU.

If the decision result in the step S201 becomes YES, a step S202 drives the switching mechanism to control the color printing unit to the receded state, so that the transport belt 28*a* and the photoconductive drum 23 of the color printing unit are separated. A step S203 decides whether or not the separation of the transport belt 28*a* and the photoconductive drum 23 of the color printing unit is completed. If the decision result in the step S203 becomes YES, the process ends.

On the other hand, if the decision result in the step S201 is NO, a step S204 decides whether or not the transport speed of the photoconductive drum 23 and the transport speed of the transport belt 28*a* are the same. If the decision result in the step S204 becomes YES, a step S205 drives the switching mechanism and controls the color printing unit to the receded state, similarly to the step S202 described above. As a result, the transport belt 28*a* and the photoconductive drum 23 of the color printing unit are separated. In this case, the photoconductive drum 23 and the transport belt 28*a* separate in a state where the two are driven at the same transport speed. In other words, the rotational speed of the photoconductive drum 23, that is, the image transfer speed, and the transport speed with which the transport belt 28*a* transports a paper 500 are the same. Hence, the photoconductive drum 23 and the transport belt 28*a* do not damage each other by slipping, and the separation is carried out stable and positively. A step S206 stops driving the photoconductive drum 23 and the transport belt 28*a*, and the process ends.

The above described return process is carried out independently with respect to each of the color printing units in a manner similar to that described above.

Therefore, the transport belt 28*a* and the photoconductive drums 23 of each of the Y, M, C and K color printing units 21Y, 21M, 21C and 21K separate only when the transport speeds of the photoconductive drums 23 and the transport speed of the transport belt 28*a* are the same. In other words, the transport belt 28*a* and each photoconductive drum 23 separate only when the transport speeds of the two are the same or when both are stationary. For this reason, it is possible to minimize the mutual damage when the transport belt 28*a* and each photoconductive drum 23 separate, and it is possible to particularly extend the serviceable life of the transport belt 28*a*.

In the described embodiments, the transport means is driven so as to make contact to and to separate from the image forming means. However, the present invention is of course applicable to the structure wherein at least one of the transport means and the image forming means is driven so that the transport means and the image forming means make contact with and separate from each other.

The present invention is applied to the color printer in each of the above described embodiments. But the present invention is of course not limited to the color printer, and is also applicable to the control of the recede/return operation of the switching mechanism in a single-color printer. In addition, the image forming apparatus to which the present invention is applicable is not limited to printers, and the present invention is of course similarly applicable to various kinds of copying machines and the like.

Further, the present invention is not limited to these embodiments, but various variations and modifications may be made without departing from the scope of the present invention.

What is claimed is:

1. An image forming apparatus comprising:

transport means for transporting a medium;

image forming means for transferring a toner image onto the medium transported by said transport means;

contacting/separating means for moving at least one of said transport means and said image forming means to a contact position where said transport means and said image forming means contact each other and to a separated position where said transport means and said image forming means are separated from each other; and control means for controlling an operation timing of said contacting/separating means depending on a predetermined unused condition indicating non-usage of said image forming means, said contacting/separating means moving at least one of said transport means and said image forming means to the contact position and/or the separated position in a state where a transport speed of said transport means and a transfer speed of said image forming means are approximately the same.

2. The image forming apparatus as claimed in claim 1, wherein said contacting/separating means moves at least one of said transport means and said image forming means to the contact position and/or the separated position in a state where the transport speed of said transport means and the transfer speed of said image forming means are approximately zero.

3. The image forming apparatus as claimed in claim 2, wherein:

said transport means comprises a belt which transports the medium, said contacting/separating means comprises a switching mechanism which contacts and separates said belt with respect to said image forming means, and said control means controls an operation timing of said switching mechanism.

4. The image forming apparatus as claimed in claim 2, wherein:

said image forming means comprises a plurality of image forming units transferring toner images of mutually different colors onto the medium, and said contacting/separating means comprises a plurality of contacting/separating units moving said transport means and/or said plurality of image forming units to contact positions where said transport means and each of said plurality of image forming units contact each other and to separated positions where said transport means and each of said plurality of image forming units are separated from each other, and independently controlling contact states between said transport means and each of said plurality of image forming units with respect to each of said plurality of image forming units.

5. The image forming apparatus as claimed in claim 2, wherein:

said image forming means comprises a photoconductive body which transfers the toner image onto the medium, and said contacting/separating means moving at least one of said transport means and said photoconductive body to the contact position and/or the separated position in a state where the transport speed of said transport means and a transport speed of said photoconductive body are approximately the same.

6. The image forming apparatus as claimed in claim 1, wherein:

said transport means comprises a belt which transports the medium, said contacting/separating means comprises a switching mechanism which contacts and separates said belt with respect to said image forming means, and said control means controls an operation timing of said switching mechanism.

7. The image forming apparatus as claimed in claim 6, wherein:

said image forming means comprises a photoconductive body which transfers the toner image onto the medium, and said contacting/separating means moving at least one of said transport means and said photoconductive body to the contact position and/or the separated position in a state where the transport speed of said transport means and a transport speed of said photoconductive body are approximately the same.

8. The image forming apparatus as claimed in claim 1, wherein:

said image forming means comprises a plurality of image forming units transferring toner images of mutually different colors onto the medium, and said contacting/separating means comprises a plurality of contacting/separating units moving said transport means and/or said plurality of image forming units to contact positions where said transport means and each of said plurality of image forming units contact each other and to separated positions where said transport means and each of said plurality of image forming units are separated from each other, and independently controlling contact states between said transport means and each of said plurality of image forming units with respect to each of said plurality of image forming units.

9. The image forming apparatus as claimed in claim 6, wherein:

said transport means comprises a belt which transports the medium, each of said plurality of contacting/separating units comprises a switching mechanism which contacts and separates said belt with respect to a corresponding one of said plurality of image forming units, and said control means controls an operation timing of said switching mechanism.

10. The image forming apparatus as claimed in claim 8, wherein:

each of said plurality of image forming units comprises a photoconductive body which transfers the toner image onto the medium, and said contacting/separating means moving at least one of said transport means and said photoconductive body of one of said plurality of image forming units to the contact position and/or the separated position in a state where the transport speed of said transport means and a transport speed of said photoconductive body are approximately the same.

11. The image forming apparatus as claimed in claim 1, wherein:

said image forming means comprises a photoconductive body which transfers the toner image onto the medium, and said contacting/separating means moving at least one of said transport means and said photoconductive body to the contact position and/or the separated position in a state where the transport speed of said transport means and a transport speed of said photoconductive body are approximately the same.

12. The image forming apparatus as claimed in claim 1, wherein:

said image forming means comprises a plurality of image forming units transferring toner images of mutually different colors onto the medium, and said predetermined unused condition indicates that at least one of said plurality of image forming units for at least one of the mutually different colors is not to be used when at least one of:

another one of the mutually different colors is used for a predetermined number of pages;

a print file or a print job is printed;

another one of the mutually different colors is manually specified; and an overlay printing is carried out.

13. The image forming apparatus as claimed in claim 1, wherein:

said transport means comprises a single belt which transports the medium, said image forming means comprises a plurality of image forming units transferring toner images of mutually different colors onto the medium, said contacting/separating means comprises a switching mechanism which contacts and separates said belt independently with respect to each of said plurality of image forming units.

* * * * *